US007744194B2

(12) United States Patent
Yokouchi

(10) Patent No.: US 7,744,194 B2
(45) Date of Patent: Jun. 29, 2010

(54) LIQUID EJECTION HEAD

(75) Inventor: Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 541 days.

(21) Appl. No.: 11/237,700

(22) Filed: Sep. 29, 2005

(65) Prior Publication Data

US 2006/0077229 A1 Apr. 13, 2006

(30) Foreign Application Priority Data

Sep. 30, 2004 (JP) ..... 2004-288786

(51) Int. Cl.
*B41J 2/14* (2006.01)
*B41J 2/05* (2006.01)
*B41J 2/045* (2006.01)

(52) U.S. Cl. ..... 347/50; 347/58; 347/68

(58) Field of Classification Search ..... 347/50, 347/9, 69, 68, 70

See application file for complete search history.

(56) References Cited

U.S. PATENT DOCUMENTS

| | | | | |
|---|---|---|---|---|
| 5,940,099 | A | 8/1999 | Karlinski | |
| 6,439,702 | B1 | 8/2002 | Karlinski | |
| 6,481,074 | B1 | 11/2002 | Karlinski | |
| 6,682,175 | B2 * | 1/2004 | Otsuka et al. | 347/54 |
| 6,766,567 | B2 | 7/2004 | Karlinski | |
| 7,201,473 | B2 * | 4/2007 | Sakaida | 347/68 |
| 7,628,470 | B2 * | 12/2009 | Mita | 347/58 |
| 2001/0015739 | A1 * | 8/2001 | Usui et al. | 347/68 |
| 2003/0030705 | A1 * | 2/2003 | Koike et al. | 347/69 |
| 2003/0088969 | A1 | 5/2003 | Karlinski | |
| 2005/0036013 | A1 * | 2/2005 | Watanabe et al. | 347/71 |

FOREIGN PATENT DOCUMENTS

| | | | |
|---|---|---|---|
| JP | 2003-512211 | A | 4/2003 |
| WO | WO 01/30577 | A1 | 5/2001 |

* cited by examiner

*Primary Examiner*—Stephen D Meier
*Assistant Examiner*—Kar Yip
(74) *Attorney, Agent, or Firm*—Birch, Stewart, Kolasch & Birch, LLP.

(57) ABSTRACT

The liquid ejection head comprises: ejection elements which include a plurality of ejection holes through which liquid is ejected, a plurality of pressure chambers in communication with the plurality of ejection holes, and a plurality of piezoelectric elements each of which deforms each of the pressure chambers and is provided on a side of the plurality of pressure chambers opposite from a side on which the ejection holes are formed; a common liquid chamber which supplies the liquid to the plurality of pressure chambers and is provided on a side of the pressure chambers opposite from the side on which the ejection holes are formed; a plurality of wiring members each of which is formed in such a manner that at least a portion of the wiring member rises upward from each of the piezoelectric elements or a vicinity of each of the piezoelectric elements through the common liquid chamber in a direction substantially perpendicular to a surface on which the piezoelectric elements are disposed, each of the wiring members including a conducting member which transmits at least one signal of a signal to be supplied to one of the ejection elements and a signal obtained from one of the ejection elements, and a covering member which is formed so as to cover the conducting member; and a coupling member which joins at least two of the wiring members adjacent to each other.

17 Claims, 26 Drawing Sheets

LIQUID EJECTION HEAD

BACKGROUND OF THE INVENTION

1. Field of the Invention

The present invention relates to a liquid ejection head, and more particularly, to technology for a liquid ejection head which ejects liquid onto a liquid receiving medium.

2. Description of the Related Art

An inkjet recording apparatus having an inkjet type of ejection head forms a desired image on a medium by ejecting ink from a plurality of nozzles provided in the ejection head. In recent years, there have been demands for improved quality of the printed image and higher printing speed in inkjet recording apparatuses. In order to meet these demands, it is necessary to reduce the size of the dots which compose the image and to increase the density of the dots. In order to reduce the dot size, the amount of ink ejected in each ejection action should be reduced by reducing the diameter of the nozzles provided in the print head. Furthermore, in order to form the dots at a high density, the nozzle arrangement inside the print head should be set to a high density.

In order to achieve finer nozzles and higher nozzle density in a print head in this way, a micro-processing technique such as etching is used, or a laminated structure is adopted in which cavity plates processed by means of a micro-processing technique are layered together. In this way, nozzles for ejecting ink, liquid chambers for accommodating ink to be ejected from the nozzles, ink flow channels, and the like, can be formed finely and accurately in a print head.

In the inkjet print head described in Japanese Patent Application Publication No. 2003-512211, in a print head in which an ink supply layer formed by a porous member which supplies ink to pressure chambers is positioned between a nozzle layer in which nozzles are formed and a cavity layer in which ink cavities (pressure chambers) are formed, piezoelectric elements are disposed on a displacement plate (diaphragm) which constitutes the ceiling of the ink cavities, wiring members are provided from the piezoelectric elements in a direction substantially perpendicular to the nozzle surface, and a substrate (wiring layer) is provided at the end of the wiring members.

However, if the nozzles of an ejection head having the structure described above are formed to a high density, then problems of the following kinds arise, and therefore, in practice, it is difficult to increase the density of the nozzles and to eject ink with good efficiency, with a structure of this kind.

For example, in the case of a structure where, taking the pressure plate (displacement plate, diaphragm) forming one face of the pressure chambers as a boundary, the pressure chambers, supply side flow channels (common liquid chamber, supply ports), and the nozzles are formed on one side of the pressure plate, and actuators such as piezoelectric elements are disposed on the opposite side of the pressure plate. In this case, if the density of the nozzles is increased, then the supply side flow channels become smaller, and if it is sought to eject ink by driving a plurality of nozzles at a high frequency (at a short ejection cycle), then the ink supply to the pressure chambers cannot keep up with demand. Therefore, if the supply side flow channels are increased in size in order to achieve a smooth supply of ink, the distance from the pressure chambers to the nozzles becomes greater and ejection becomes more difficult to perform. Layout restrictions of this kind relating to the size of the supply side flow channels make it difficult to set a high ejection frequency.

Furthermore, if the number of nozzles provided in the ejection head is increased in order to achieve a high nozzle density, the number of actuators and the number of actuator wires also increase accordingly. This makes it difficult to dispose (pattern) the wires onto the same surface (for example, the pressurization plate on which the piezoelectric elements are positioned) as in the related art.

In the inkjet print head described in Japanese Patent Application Publication No. 2003-512211, since piezoelectric elements, conductive bonding elements, a printed substrate mounted with a driver chip, and the like, are provided between the ink supply layer and the ink manifold which accumulates ink to be supplied to the ink supply layer, then the ink flow channel from the ink manifold to the ink supply layer is long. Thus, as the density of the nozzles becomes increased, and there is a possibility that the ink supply from the ink manifold to the nozzles will not be able to meet demand.

SUMMARY OF THE INVENTION

The present invention has been contrived in view of the foregoing circumstances, an object thereof being to provide a liquid ejection head having a desirable structure in order to achieve high density of the nozzles, as well as enabling ejection at high ejection frequency.

In order to attain the aforementioned object, the present invention is directed to a liquid ejection head, comprising: ejection elements which include a plurality of ejection holes through which liquid is ejected, a plurality of pressure chambers in communication with the plurality of ejection holes, and a plurality of piezoelectric elements each of which deforms each of the pressure chambers and is provided on a side of the plurality of pressure chambers opposite from a side on which the ejection holes are formed; a common liquid chamber which supplies the liquid to the plurality of pressure chambers and is provided on a side of the pressure chambers opposite from the side on which the ejection holes are formed; a plurality of wiring members each of which is formed in such a manner that at least a portion of the wiring member rises upward from each of the piezoelectric elements or a vicinity of each of the piezoelectric elements through the common liquid chamber in a direction substantially perpendicular to a surface on which the piezoelectric elements are disposed, each of the wiring members including a conducting member which transmits at least one signal of a signal to be supplied to one of the ejection elements and a signal obtained from one of the ejection elements, and a covering member which is formed so as to cover the conducting member; and a coupling member which joins at least two of the wiring members adjacent to each other.

According to the present invention, the plurality of wiring members, arranged two-dimensionally on the surface where the piezoelectric elements are disposed and each having the conducting member which transmits the signal to the piezoelectric elements disposed inside the common liquid chambers and the covering members which cover the outer side of the conducting members, are composed in such a manner that mutually adjacent wiring members are coupled by means of the coupling members. Therefore, the strength and rigidity of the liquid ejection head and the common liquid chambers are increased, and the accuracy of positioning the wiring members on the installation face is also improved.

The signals supplied to the ejection elements include drive signals for driving the piezoelectric elements. Furthermore, the signals obtained from the ejection elements may include determination signals obtained, for example, from a pressure sensor which determines the pressure in the pressure chamber, or a temperature sensor which determines the temperature of the pressure chamber, if such a sensor is provided.

The wiring members may transmit signals supplied to the ejection elements, and they may also transmit signals obtained from the ejection elements. Furthermore, they may also transmit both signals supplied to the ejection elements and signals obtained from the ejection elements.

It is also possible to provide electrodes forming sections for taking the signal transmitted, in the wiring members. For example, there is a mode in which electrodes are provided on the surface side (outer side) of the covering member or on sections where the covering member has been removed, at either end of the wiring member.

"Ejection receiving medium" indicates a medium on which an image is recorded by means of the action of the ejection head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an inkjet head, and the like.

The liquid ejection head may be a full line type head in which ejection holes are arranged through a length corresponding to the entire width of the ejection receiving medium, or a serial type head (shuttle scanning type head) in which a short head having ejection holes arranged through a length that is shorter than the entire width of the ejection receiving medium ejects recording liquid onto the ejection receiving medium while scanning is performed in the width direction of the ejection receiving medium.

A full line ejection head may be formed to a length corresponding to the full width of the recording medium by combining short head having rows of ejection holes which do not reach a length corresponding to the full width of the ejection receiving medium, these short heads being joined together in a staggered matrix fashion.

Preferably, the plurality of ejection holes are arranged two-dimensionally in a row direction and a column direction; and the plurality of wiring members are arranged two-dimensionally in the row direction and the column direction on the surface on which the piezoelectric elements are disposed.

Since the wiring members are arranged two-dimensionally on the surface where the piezoelectric elements are disposed, it is possible to install the piezoelectric elements (and the nozzle connected to the pressure chambers on which the piezoelectric elements are provided) and the wiring members, at a high density.

For example, the row direction may be taken to be the lengthwise direction of the liquid ejection head and the column direction may be taken to be an oblique direction which is not perpendicular to the row direction. Furthermore, the column direction may also be a direction which is perpendicular to the row direction (in other words, the width direction of the liquid ejection head).

Preferably, the coupling member is made from a material including a material of the covering member.

By making the coupling members and the covering members from a material including the same material, the coefficient of thermal expansion is the same in the coupling members and the covering members. Therefore, disconnection or cracking at the joints, which may occur during heating (heat treatment) if the coupling members and the covering members have different coefficients of thermal expansion, can be prevented, and the bonding strength between the coupling members and the covering members can be improved.

Preferably, the coupling member and the covering member are integrally formed from a material including resin.

If the coupling members and the covering members are integrally formed using a resin material, then it is possible to simplify the manufacturing steps, and the accuracy during manufacture can be improved and stabilized.

Preferably, the coupling member is formed in at least one direction of the row direction and the column direction.

Since the coupling members are formed in at least one direction of the row direction and the column direction of the arrangement of wiring members, it is possible to improve the strength and rigidity of the liquid ejection head by means of the simple coupling structure.

In order to improve the strength and rigidity in both the row direction and the column direction, a desirable mode is one in which coupling members are formed in both the row direction and the column direction.

Alternatively, it is also preferable that the coupling member is formed in a direction which is different from the row direction and the column direction.

For example, if coupling members are formed in an oblique direction which is different from the row direction and the column direction, then the wiring members can be coupled together tightly, and improved strength and rigidity can be expected.

Alternatively, it is also preferable that the coupling members are formed in the row direction, the column direction, and a direction that is different from the row direction and the column direction, and the coupling members have a coupling structure in which at least three of the wiring members adjacent to each other are coupled by means of the coupling members.

If the coupling members are used in the row direction, the column direction, and a direction which is different from the row direction and the column direction, then the wiring members can be coupled together even more tightly, and improved strength and rigidity can be expected.

For example, one mode for coupling three wiring members is a mode which uses three coupling members formed respectively in the row direction, the column direction and an oblique direction which is different from the row direction and column direction.

Preferably, the coupling member includes a plate-shaped member which joins at least three of the wiring members adjacent to each other, the plate-shaped member having a prescribed shape when projected onto the surface on which the wiring members are disposed.

If the coupling members having the plate shape are used to couple together three or more wiring members, then further improvement in strength can be expected.

The prescribed planar shape of the coupling members is determined according to the number of wiring members to be coupled. For example, if the coupling member couples together three wiring members, then a substantially triangular shape may be adopted for the planar shape of the coupling member. Furthermore, in a mode where four wiring members are to be coupled together, a substantially quadrilateral shape may be adopted for the planar shape of the coupling member. Curves may be used for the edges of the planar shapes, and it may have apices in positions apart from the wiring members.

Preferably, the coupling member joins the plurality of wiring members having a plurality of coupling positions of different heights for the coupling member.

For example, there is a mode in which the coupling positions for the coupling members are at the upper end (or the lower end) of the wiring members in respect of coupling members formed in the row direction, and the coupling positions for the coupling members are at the lower end (or the upper end) of the wiring members in respect of coupling members formed in the column direction.

It is also possible to provide coupling positions for coupling (bonding) the wiring members and the coupling members at positions other than the upper end or the lower end.

Preferably, the coupling member joins the plurality of wiring members having at least two coupling positions of different heights for the coupling member.

For example, there is a mode in which, of two wiring members coupled together by a coupling member, one wiring member has a coupling position at the upper end and the other wiring member has a coupling position at a position other than the upper end. In other words, the coupling member may have a length that is greater than the distance between the two wiring members that are coupled together by the coupling member.

Preferably, the plurality of wiring members include wiring members having a non-coupled structure where the coupling member is not provided between the wiring members adjacent to each other.

If the coupling members are formed (disposed) densely, then the strength and rigidity of the liquid ejection head can be increased, but on the other hand, the flow path resistance inside the common liquid chamber where the wiring members and the coupling members are installed is increased. If the flow path resistance increases, then liquid ejection characteristics and refill characteristics decline, and it becomes impossible to ejection liquid at a short ejection cycle (high ejection frequency). Therefore, the fluid resistance inside the common liquid chamber is reduced by providing the non-coupled structure, and hence a desirable balance can be obtained between the strength and rigidity of the liquid ejection head, and the fluid resistance inside the common liquid chamber.

Preferably, liquid-contacting sections of the coupling member and the covering member which make contact with the liquid accommodated in the common liquid chamber have affinity for the liquid.

By providing the coupling members and the covering members (liquid-contacting members) of the wiring members with affinity for the liquid, it is possible to prevent increase of the flow path resistance inside the common liquid chamber, and to prevent the occurrence of air bubbles (intermixing of air bubbles) into the common liquid chamber.

Preferably, the coupling member is provided with a cavity section.

Since the cavity section functions as a damper inside the common liquid chamber, it is possible to prevent cross-talk and suppress transient phenomena occurring in the pressure wave of the liquid.

The cavity section may be provided in at least one portion of the coupling member inside the common liquid chamber. Furthermore, the coupling members provided with the cavity section should be provided in the vicinity of the supply ports which connect the pressure chambers with the common liquid chamber.

Preferably, the coupling member has a filter structure comprising a plurality of through holes.

By providing the plurality of through holes in the coupling members, the coupling members function as a filter inside the common liquid chamber, and therefore infiltration of air bubbles, foreign matter, and ink of increased viscosity (solidified ink) into the nozzles can be prevented.

The shape (planar shape) of the through holes may be a substantially circular shape, a substantially elliptical shape, or a substantially polygonal shape. Furthermore, the size of the through holes is decided according to the size of the air bubbles and foreign matter that are to be handled. It is also possible to provide the through holes of different shapes and/or different sizes (two or more types of through holes).

Preferably, the coupling member has a shape in which angular portions of the coupling member are chamfered.

By using the chamfered shape for the coupling members, the flow path resistance due to the coupling members is reduced, and expulsion of air bubbles from the common liquid chamber is improved.

The chamfered shape may be such that the apices of the cross-sectional shape in a cross-section substantially perpendicular to the lengthwise direction of the coupling member have an angle exceeding 90°. A desirable mode is one in which the cross-sectional shape is a circular shape.

Preferably, the liquid ejection head further comprises: a plurality of wiring member blocks including the coupling members, and the wiring members coupled together by the coupling members, wherein the wiring member blocks are arranged in a wiring member installation region where the wiring members are installed.

If the wiring members coupled by the coupling members are formed at once for the whole of the liquid ejection head (the common liquid chamber), then the positional variation of the wiring members will become large due to the processing accuracy in manufacture. Therefore, it is possible to reduce the positional variation of the wiring members by arranging the plurality of wiring member blocks, each having a size which is smaller than the region of the common liquid chamber in which the wiring members are disposed.

It is possible to arrange the plurality of wiring member blocks having the same size (the same number of wiring members, and/or the same number of coupling members), and it is also possible to arrange the wiring member blocks of a plurality of types having different sizes.

The plurality of coupling members in the wiring member block may have the same shape, or the plurality of coupling members having different shapes may be provided.

Preferably, the wiring member blocks include the wiring member blocks having different coupling structures; and the wiring member blocks having the different coupling structures are combined in the wiring member installation region.

If the wiring member blocks having different wiring structures are used, for instance, then the wiring member block having the sparse coupling structure (a small number of coupling members) may be used in a region where the flow rate of the liquid is to be ensured by lowering the flow path resistance, and the wiring member block having the dense coupling structure (a large number of coupling members) may be used in a region where high strength (rigidity) is required.

According to the present invention, the plurality of wiring members, arranged two-dimensionally on the surface where the piezoelectric elements are disposed and each having the conducting member which transmits the signal to the piezoelectric elements disposed inside the common liquid chamber and the covering member which covers the outer side of the conducting member, are composed in such a manner that mutually adjacent wiring members are coupled by means of the coupling members. Therefore, the strength and rigidity of the liquid ejection head and the common liquid chamber are increased, and the accuracy of positioning the wiring members on the installation face is also improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
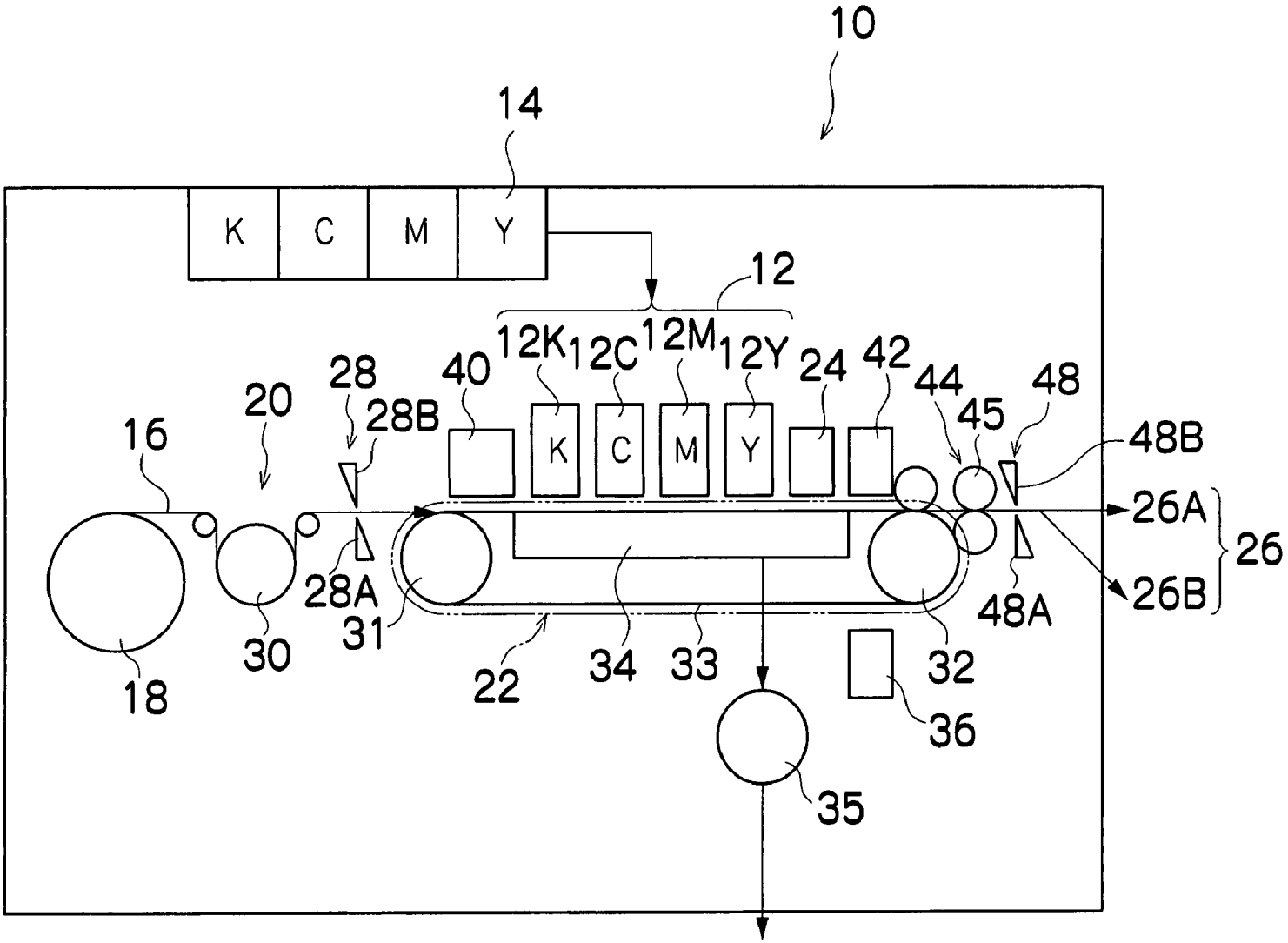
FIG. 1 is a general schematic drawing of an inkjet recording apparatus installed with a print head relating to an embodiment of the present invention.

FIG. 1 is a general schematic drawing of an inkjet recording apparatus using a liquid ejection head according to an embodiment of the present invention. As shown in FIG. 1, the inkjet recording apparatus 10 comprises: a print unit 12 having a plurality of print heads (liquid ejection heads) 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16, which forms a recording medium (ejection receiving medium); a decurling unit 20 removing curl in the recording paper 16; a suction belt conveyance unit 22 disposed facing the nozzle face (ink-droplet ejection face) of the print unit 12, for conveying the recording paper 16 while the recording paper 16 is kept to be flat; and a paper output unit 26 for outputting printed recording paper 16 (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 5) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing, so that the ink deposited on the recording paper 16 dries more easily.

Figure 2:
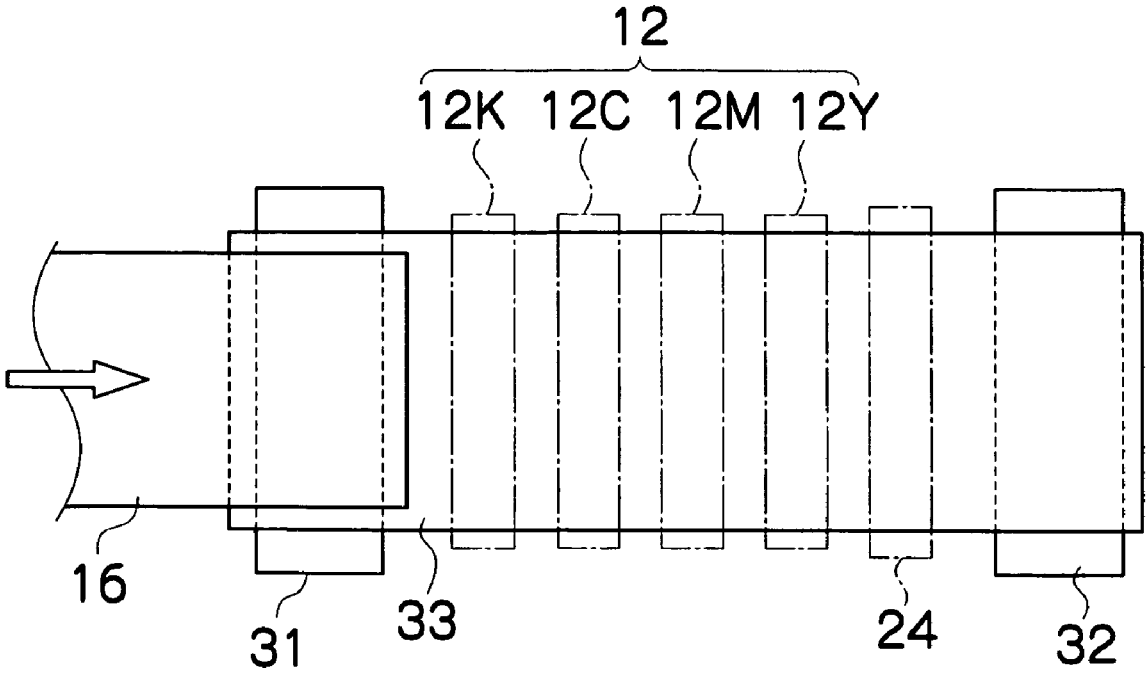
FIG. 2 is a plan view of the principal part of the peripheral area of a print unit in the inkjet recording apparatus shown in FIG. 1.

The print heads 12K, 12C, 12M and 12Y of the print unit 12 are full line print heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective print heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line print heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a print head will be described. The print heads 12K, 12C, 12M and 12Y of the respective ink colors have the same structure, and a reference numeral 50 is hereinafter designated to any of the print heads.

Figure 3A:
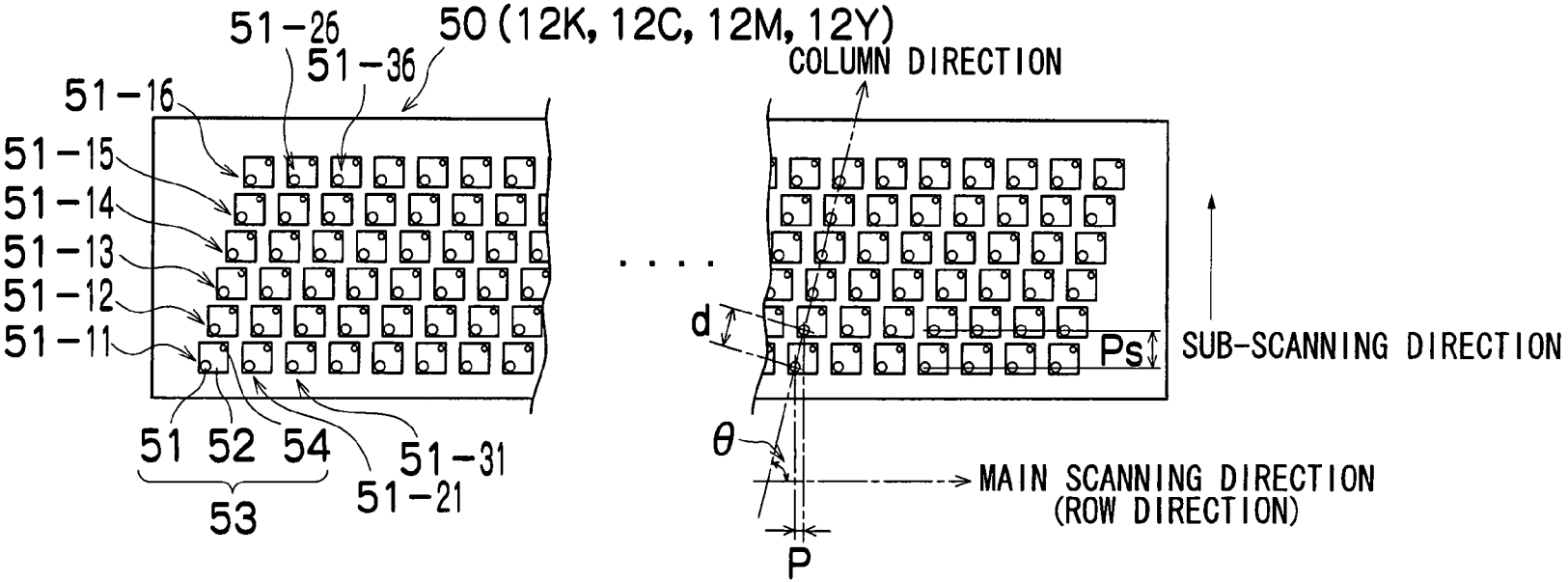
FIGS. 3A and 3B are plan view perspective diagrams showing an example of the composition of a print head.
Figure 3B:
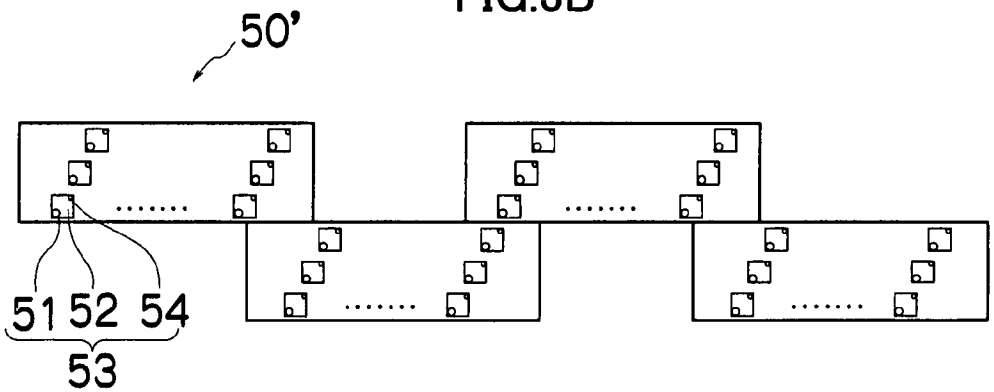

FIG. 3A is a plan view perspective diagram showing an example of the structure of the print head 50; and FIG. 3B is a plan view perspective diagram showing a further example of the structure of the print head 50. In order to achieve a high density of the dot pitch printed onto the surface of the recording paper 16, it is necessary to achieve a high density of the nozzle pitch in the print head 50. As shown in FIG. 3A, the print head 50 according to the present embodiment has a structure in which a plurality of ink chamber units 53, each including a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced (high nozzle density is achieved).

There are no particular limitations on the size of the nozzle arrangement in the print head 50 of this kind. As one example, 2400 nozzles per inch (npi) can be achieved by arranging nozzles 51 in 600 rows (305 mm) in the row direction (the lengthwise direction of the print head 50) and 48 columns (21 mm) in the column direction (the width direction of the print head 50).

Furthermore, as shown in FIGS. 3A and 3B, when the pressure chamber 52 is viewed from above, the planar shape thereof is a substantially square shape, and a nozzle 51 is formed at one end of a diagonal of the pressure chamber 52, while a supply port 54 is provided at the other end thereof. The planar shape of the pressure chamber 52 is not limited to a square shape of this kind, and it may also be a substantially rectangular shape, a circular shape, an elliptical shape, and the like.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3B, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The ink chamber units 53 having this structure are composed in a lattice arrangement, based on a fixed arrangement pattern having a row direction which corresponds to the lengthwise direction of the print head (main scanning direction), and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles which are projected to an alignment in the main scanning direction is $d \times \cos\theta$.

More specifically, the arrangement can be treated equivalently to one in which the respective nozzles 51 are arranged in a linear fashion at a uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch, or 2400 dots per inch). Below, in order to facilitate the description, it is supposed that the nozzles 51 are arranged in a linear fashion at a uniform pitch (P), in the longitudinal direction of the print head (main scanning direction).

The aforementioned angle $\theta$ is a very small angle, and in order to facilitate the description and the illustrations, the nozzles 51 are depicted as being arranged in a linear fashion at a uniform pitch Ps ($=d \times \sin\theta$) in the width direction of the print head 50 (the sub-scanning direction, or the conveyance direction of the recording paper 16).

When the nozzles 51 in a print head having the matrix structure described above are driven, "main scanning" is defined as printing a line formed of a row of dots, or a line formed of a plurality of rows of dots in the width direction of the recording paper 16 (the direction perpendicular to the conveyance direction of the recording paper 16) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIGS. 3A and 3B are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line formed of a row of dots, or a line formed of a plurality of rows of dots formed by the main scanning, while the full-line head and the recording paper are moved relatively to each other.

Moreover, in implementing the present invention, the arrangement of the nozzles is not limited to that of the example illustrated.

Figure 4:
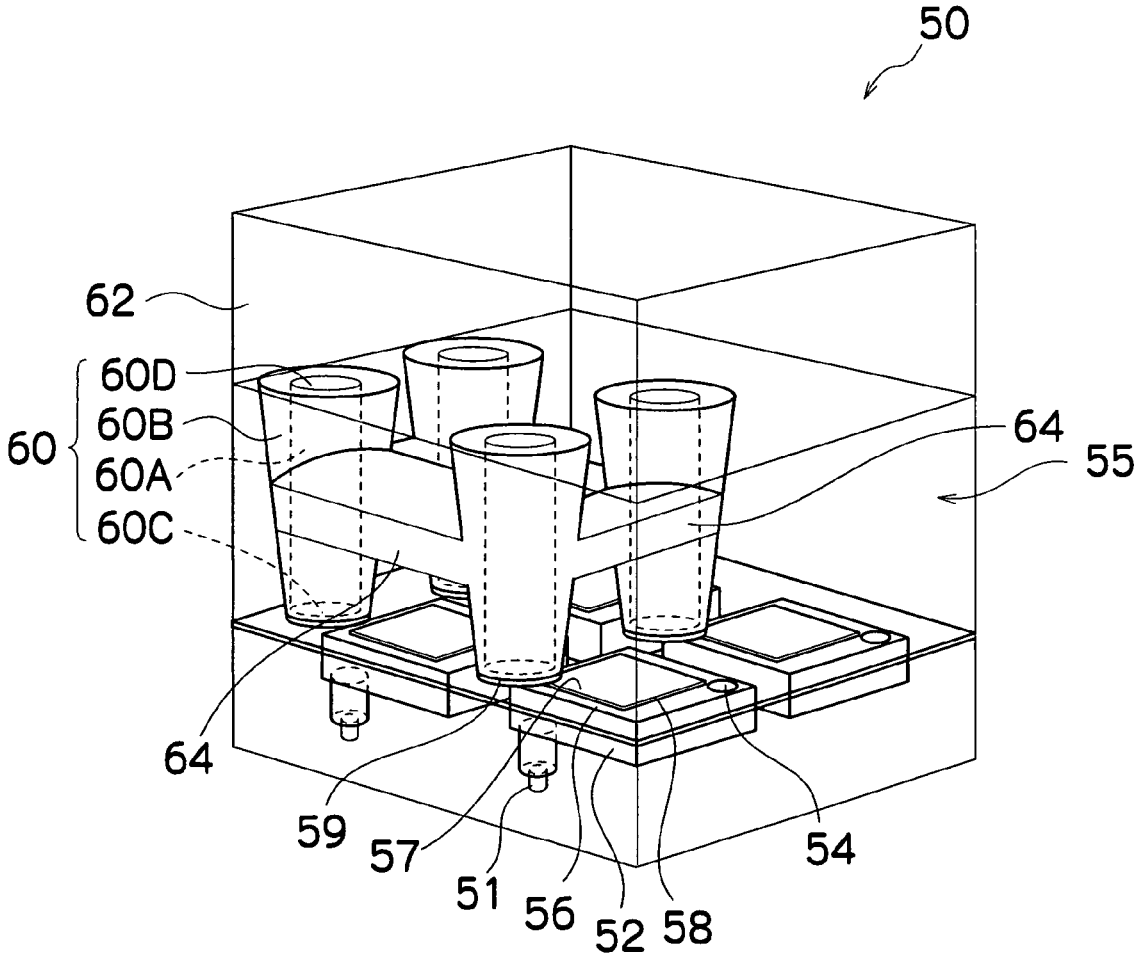
FIG. 4 is a diagram showing the three-dimensional structure of the print head shown in FIG. 1.

FIG. 4 is an oblique perspective diagram showing the approximate composition of the print head 50 relating to an embodiment of the present invention. FIG. 4 shows an extracted and simplified view of a portion of the print head 50 (the portion including four ink chamber units 53).

In the print head 50 shown in this embodiment, the pressure chambers 52 provided corresponding to the respective nozzles 51 which eject ink are each connected to a common liquid chamber 55 via an ink supply port 54. Furthermore, a piezoelectric element (actuator) 58 provided with an individual electrode 57 is bonded to a (diaphragm) pressure plate 56 which forms the ceiling of the pressure chamber, and the piezoelectric element 58 is deformed when a drive voltage is supplied to the individual electrode 57, thereby causing ink to be ejected from the nozzle 51. When ink is ejected, new ink is supplied to the pressure chamber 52 from the common flow chamber 55, via the supply port 54.

Furthermore, the common liquid chamber 55 which supplies ink to the pressure chambers 52 is disposed on the opposite side of the diaphragm 56 with respect to the pressure chambers 52. In other words, the print head 50 has a structure in which the pressure chambers 52 are provided on one side of the diaphragm 56, and the common liquid chamber 55 is provided on the other side of the diaphragm 56, supply ports 54 for connecting the pressure chambers 52 with the common liquid chamber 55 being formed in the diaphragm 56 in such a manner that the pressure chambers 52 and the common liquid chamber 55 are connected directly by means of the supply ports 54.

By using a structure which supplies ink directly from the common liquid chamber 55 to the pressure chambers 52 in order to prioritize ink refilling characteristics, flow channels (tubes) from the common liquid chamber 55 to the pressure chambers 52, which create a fluid resistance on the supply side flow path, are eliminated, and a high level of integration of the ink supply system, including the supply side flow channels, is achieved.

In the present embodiment, the diaphragm 56 is formed by a conductive thin film made of stainless steel, or the like, and also functions as a common electrode for the piezoelectric elements 58. Piezoelectric elements 58 having individual electrodes 57 on the surface opposite to the diaphragm 56 are provided on the surface of the diaphragm 56 which is on the opposite side to the pressure chambers 52 (namely, the same side as the common liquid chamber 55).

A diaphragm 56 made from one plate may be provided as a common diaphragm for all of the pressure chambers, or one diaphragm 56 may be provided for each pressure chamber 52 and each of the diaphragms 56 may be connected together electrically if the diaphragms 56 are also to serve as a common electrode. For example, it is possible to adopt a mode in which common diaphragms 56 are provided in blocks, or the like, in such a manner that a plurality of pressure chambers 52 have a common diaphragm 56, and a plurality of these common diaphragms 56 are provided.

In the piezoelectric element-free region of the diaphragm 56 where no piezoelectric elements 58 are positioned (formed) on the side of the diaphragm 56 where the piezoelectric elements 58 are formed, electrode pads 59 extending respectively from the individual electrodes 57 are formed and wiring members 60 for supplying a drive signal to be applied to the respective piezoelectric elements 58 (individual electrodes 57) are bonded to these electrode pads 59.

Although the detailed structure of the wiring members 60 is described hereinafter, the wiring members 60 have a substantially circular column shape as shown in FIG. 4 (in the example shown in FIG. 4, a circular column shape in which one end is broader than the other end), and respectively comprise: a conducting member 60A (indicated by a broken line), which is formed in the approximate center region of the circular column and functions as a wire for transmitting signals; a covering member 60B (indicated by a solid line), which covers the outer side of the conducting member 60A and protects the conducting section; an electrode 60C (indicated by a broken line), which is formed on the base surface of the circular column and is an electrode for extracting the drive voltage transmitted by the conducting member 60A; and an electrode 60D (indicated by a solid line), which is formed on the opposite end to the electrode 60C.

Furthermore, the wiring members 60 are bonded to the electrode pad 59 by means of a conductive adhesive, solder, or the like, so as to be connected electrically between the electrode 60C and the electrode pad 59. The wiring members 60 are disposed so as to rise up vertically from the electrode pad 59 and pass through the common liquid chamber 55 (through the two or more walls forming the common liquid chamber 55).

A multi-layer flexible substrate 62 formed with a plurality of wires for transmitting drive voltages to the plurality of piezoelectric elements 58 provided in the print head 50 is provided on the opposite side (on the same side as electrode 60D on the wiring members 60) of the common liquid chamber 55 from the pressure chambers 52. The wires inside the flexible substrate 62 (electrodes extending from the respective wires which are not shown in the diagrams) are bonded to the electrodes 60D of the wiring members 60 so as to form an electrical connection between the wires and the electrodes 60D, by means of a conductive adhesive, solder, or the like.

Furthermore, the space in which the column-shaped wiring members 60 are erected between the diaphragm 56 and the flexible substrate 62 forms the common liquid chamber 55 for supplying ink to the respective pressure chambers 52 via the respective supply ports 54.

The liquid-contacting regions of the flexible substrate 62 which make contact with the ink in the common liquid chamber 55 are provided with a protective member (not shown in FIG. 4 and indicated by reference numeral 112 in FIG. 7), with the object of protecting the flexible substrate 62 and the wires (electrodes) formed in the flexible substrate 62 from the ink inside the common liquid chamber 55, as well as ensuring insulating properties with respect to the ink. A member having ink resistant properties and/or insulating properties may be used as the protective member, and a protective film may be formed (by coating) onto the portions of the flexible substrate 62 which make contact with the ink.

The common liquid chamber 55 shown in FIG. 4 is one large space formed throughout the whole region where the pressure chambers 52 are formed, in such a manner that the common liquid chamber 55 supplies ink to all of the pressure chambers 52 shown in FIGS. 3A and 3B. However, the common liquid chamber 55 is not limited to being formed as one space, and the common liquid chamber 55 may include a plurality of chambers formed by dividing up the space into several regions.

The wiring members 60, which rise up perpendicularly like a column on top of the electrode pads 59 extending from the individual electrodes 57 at each pressure chamber 52, support the flexible substrate 62 from below, thus a space which forms the common liquid chamber 55 is created.

In this specification, the wiring members 60 which rise up like columns in this way may also be called "electric columns", due to their shape. In other words, the wiring members (electrical columns) 60 are formed so as to pass through the common liquid chamber 55.

The wiring members 60 shown in FIG. 4 are formed independently with respect to each of the piezoelectric elements 58 (or the individual electrodes 57 thereof), in a one-to-one correspondence. In order to reduce the number of wires (the number of electrical columns), it is also possible to make one wiring member 60 with respect to a plurality of piezoelectric elements 58, in such a manner that the wires corresponding to several piezoelectric elements 58 are gathered together and formed into one wiring member 60. Moreover, in addition to the wiring to the individual electrodes 57, the wiring to the common electrode (diaphragm 56) may also be formed as a wiring member 60.

Furthermore, although not shown in the drawings, if a pressure sensor for determining the pressure in the pressure chamber 52, and a temperature sensor, or the like, are provided, then it is possible to use the wiring members 60 as wires for transmitting the determination signals obtained from the sensors.

In other words, the wiring members 60 formed inside the common liquid chamber 55 may include the wiring members 60 for the drive signals which transmit drive voltages for supply to the ejection elements comprising a nozzle 51, a pressure chamber 52 and a piezoelectric element 58, and the wiring members 60 for determination signals which transmit signals obtained from the ejection elements, such as determination signals obtained from pressure sensors and the like.

FIG. 4 shows the wiring members 60 which are formed in a tapered shape, but the shape of the wiring members 60 is not limited to this. The wiring members 60 may also adopt a substantially circular column shape or a square column shape, or the like. The shape of the wiring members 60 is related to the method of manufacturing the wiring members 60. The method of manufacturing the wiring members 60 is described hereinafter.

Furthermore, as shown in FIG. 4, the interior of the common liquid chamber 55 has a structure in which the wiring members 60 that are mutually adjacent in the row direction and the column direction of the arrangement of ink chamber units 53 are coupled together by means of column-shaped coupling members 64. These coupling members 64 are formed from the same material as the covering members 60B of the wiring members 60.

In the present embodiment, a dual-structure wiring member 60 having a conducting member 60A formed inside and a covering member 60B formed outside is described. It is also possible to form a dual structure of the covering members 60B, the inner covering member 60B, which makes contact with the conducting member 60A, including an insulating member made from a material (such as resin or silicone rubber) having insulating properties, and the outer covering member 60B (in other words, in the portion which makes contact with the ink inside the common liquid chamber 55) including a protective member made from a material (such as stainless steel, or another metal) having ink resistant properties.

If the covering member 60B is formed with a dual structure (and the wiring member 60 is formed with a triple structure), the coupling member 64 is formed from the same material as the protective member formed on the outer side of the covering member 60B (in other words, a metal material). By providing an ink resistance treatment on the surface of the insulating member (by forming a protective film on the surface), it is also possible to display ink resistant properties by means of protective film.

In other words, the coupling member 64 is formed from the same material as the material used in the outermost side of the wiring member 60 (the portion that makes contact with the ink in the common liquid chamber 55).

In a wiring member 60 having a dual structure comprising a conducting member 60A and a covering member 60B, the covering member 60B functions as an insulating member which ensures insulation between the conducting member 60 and the ink, and also functions as a protective member which protects the conducting member 60A from oxidation (corrosion) by the ink. In other words, the covering member 60B serves both as an insulating member and as a protective member (ink resisting member).

In the mode shown in FIG. 4, each wiring member 60 has a coupling position where it is coupled to a coupling member 64, at a position which is substantially the same distance from either end of the wiring member 60, where the electrodes 60C and 60D are formed (in other words, at a central point which bisects the height of the wiring member 60). The coupling structure of the wiring members 60 is described hereinafter.

Here, there are no particular restrictions on the size of the print head 50 described above. To give one example, the planar shape of the pressure chambers 52 may be an approximately square shape of 300 μm×300 μm (the corners thereof being curved in order to prevent stagnation points in the ink flow), and the height of the pressure chambers is 150 μm, while the diaphragm 56 and the piezoelectric elements 58 each have a thickness of 10 μm, the wiring members 60 have a diameter of 100 μm at the electrode 60C which forms the connection with the electrode pad 59, and a height of 500 μm.

Description of Ink Supply System

Next, the ink supply system of the inkjet recording apparatus 10 will be described.

An ink supply tank (not shown), which is a base tank for supplying ink, is provided in the ink storing and loading unit 14 shown in FIG. 1. The ink supply tank may adopt a system for replenishing ink by means of a replenishing opening (not shown), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

Furthermore, a filter (not shown) is provided between the ink supply tank and the print head 50 in order to remove foreign matter and air bubbles. Desirably, the filter mesh size is the same as the nozzle diameter, or smaller than the nozzle diameter (generally, about 20 μm).

Desirably, a composition is adopted in which a sub-tank (not shown) is provided in the vicinity of the print head 50, or in an integrated fashion with the print head 50. The sub-tank has a damper function for preventing variation in the internal pressure of the head and a function for improving refilling of the print head.

Furthermore, the inkjet recording apparatus 10 is also provided with a cap (not shown) and a cleaning blade (not shown). The cap is a device for preventing the nozzles 51 from drying out, and prevents increase in the viscosity of the ink in the vicinity of the nozzles. The cleaning blade (not shown) forms a device for cleaning the surface of the nozzles.

A maintenance unit including the cap and the cleaning blade can be moved in a relative fashion with respect to the print head 50 by a movement mechanism (not shown), and the maintenance unit is moved, as required, from a predetermined holding position to a maintenance position below the print head 50.

The cap is displaced upwards and downwards in a relative fashion with respect to the print head 50 by an elevator mechanism (not shown). When the power supply is off, or when the apparatus is at standby, the cap is raised to a prescribed raised position and sealed tightly onto the print head 50, thereby covering the nozzle surface with the cap.

During printing or standby, if the use frequency of a particular nozzle 51 is low, and if it continues in a state of not ejecting ink for a prescribed time period or more, then the solvent of the ink in the vicinity of the nozzle evaporates and the viscosity of the ink increases. In a situation of this kind, it becomes impossible to eject ink from the nozzle 51, even if the piezoelectric element 58 is operated.

Therefore, before the situation of this kind develops (while the ink is within a range of viscosity which allows it to be ejected by operation of the piezoelectric element 58), the piezoelectric element 58 is operated, and a preliminary ejection ("purge", "blank ejection", "liquid ejection" or "dummy ejection") is carried out, in order to expel the degraded ink (namely, the ink in the vicinity of the nozzle which has increased viscosity) toward the cap (ink receptacle).

Furthermore, if air bubbles enter into the ink inside the print head 50 (inside the pressure chamber 52), then even if the piezoelectric element 58 is operated, it will not be possible to eject ink from the nozzle. In a case of this kind, the cap is placed on the print head 50, the ink (ink containing air bubbles) inside the pressure chambers 52 is removed by suction, by means of a suction pump (not shown), and the ink removed by suction is then supplied to a recovery tank (not shown).

This suction operation is also carried out in order to remove degraded ink having increased viscosity (hardened ink), when ink is loaded into the head for the first time, or when the head starts to be used after the inkjet recording apparatus has been out of use for a long period of time. Since the suction operation is carried out with respect to all of the ink inside the pressure chambers 52, the ink consumption is considerably large. Therefore, desirably, preliminary ejection is carried out while the increase in the viscosity of the ink is still minor.

The cleaning blade is composed of rubber or another elastic member, and can slide on the ink ejection surface (surface of the nozzle plate) of the print head 50 by means of a blade movement mechanism (wiper) which is not shown. When ink droplets or foreign matter has adhered to the nozzle plate, the surface of the nozzle plate is wiped and cleaned by sliding the cleaning blade on the nozzle plate. Further, when ink ejection surface is cleaned by the blade mechanism, a preliminary discharge is carried out in order to prevent the foreign matter from becoming mixed inside the nozzles 51 by the blade.

Description of Control System

Figure 5:
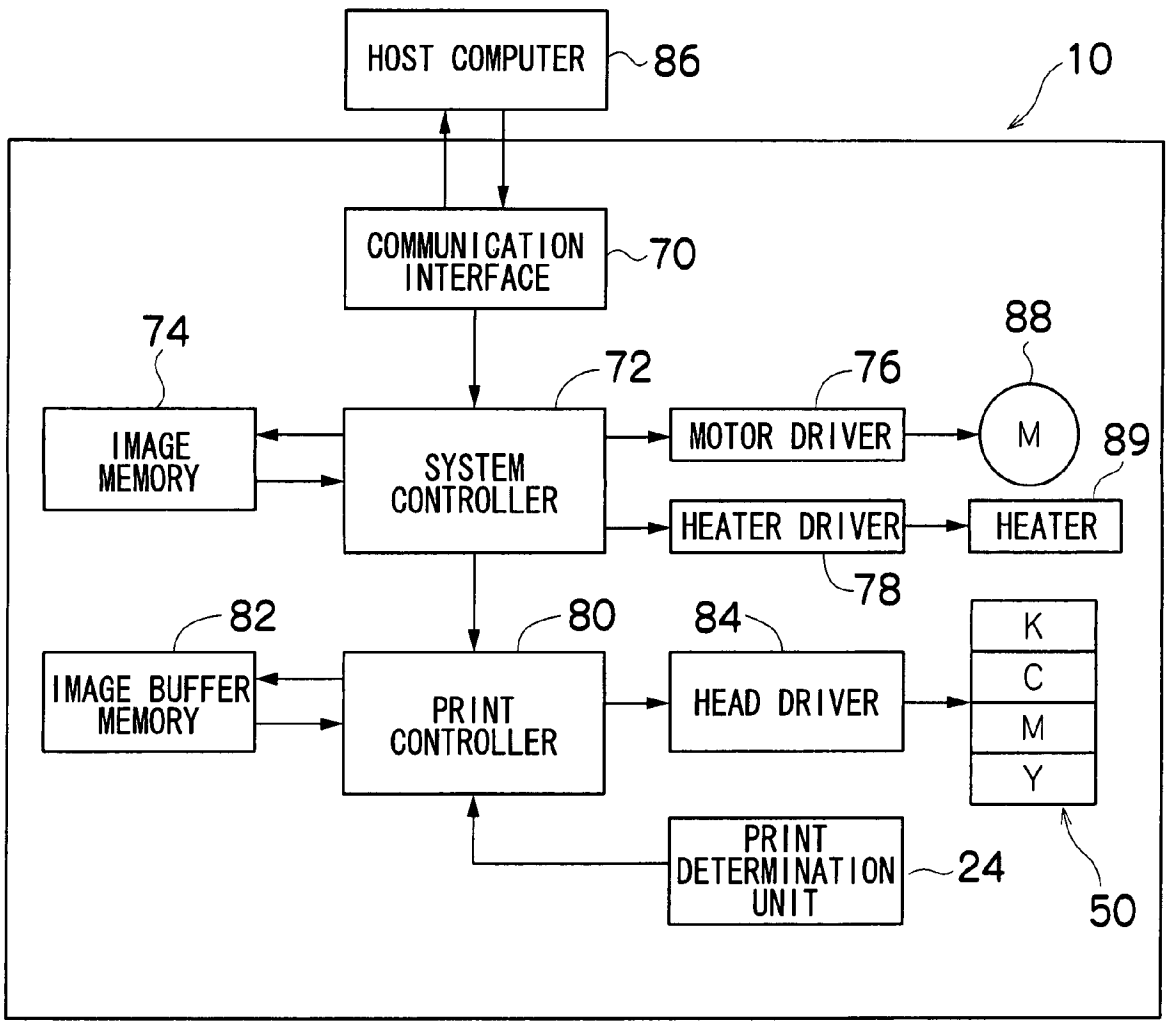
FIG. 5 is a principal block diagram showing the system configuration of the inkjet recording apparatus.

FIG. 5 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communication interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signals (print data) to the head driver 84. Required signal processing is carried out in the print controller 80, and the ejection amount and the ejection timing of the ink droplets from the respective print heads 50 are controlled via the head driver 84, on the basis of the print data. By this means, desired dot size and desired dot positions can be achieved.

The print controller 80 is provided with the image buffer memory 82; and image data, parameters, and other data are temporarily stored in the image buffer memory 82 when image data is processed in the print controller 80. The aspect shown in FIG. 5 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the actuators of the print heads of the respective colors 12K, 12C, 12M, and 12Y on the basis of print data supplied by the print controller 80. The head driver 84 can be provided with a feedback control system for maintaining constant drive conditions for the print heads.

Various control programs are stored in a program storage section (not shown), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not shown).

The print determination unit 24 is a block that includes the line sensor as described above with reference to FIG. 1, reads the image printed on the recording paper 16, determines the print conditions (presence of the ejection, variation in the dot formation, and the like) by performing required signal processing, or the like, and provides the determination results of the print conditions to the print controller 80.

Furthermore, according to requirements, the print controller 80 makes various corrections with respect to the print head 50 on the basis of information obtained from the print determination unit 24.

In the example shown in FIG. 1, the print determination unit 24 is provided on the print surface side, the print surface is irradiated with a light source (not shown), such as a cold cathode fluorescent tube disposed in the vicinity of the line sensor, and the reflected light is read in by the line sensor. However, in implementing the present embodiment, another composition may be adopted.

Detailed Structure of Ink Chamber Unit

Next, the structure of the ink chamber unit 53 provided in the print head 50 will be described in detail.

Figure 6:
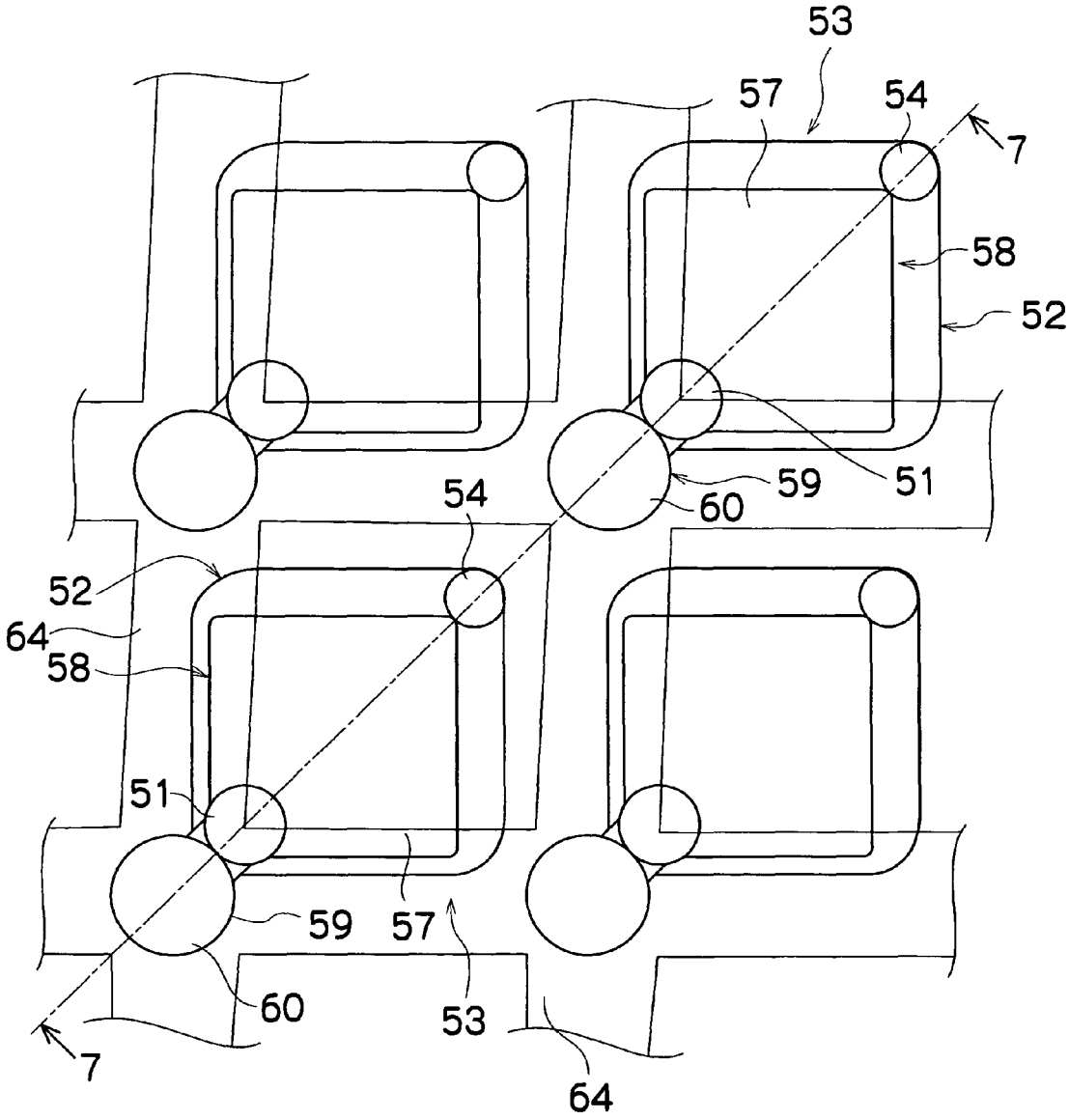
FIG. 6 is an enlarged view showing a nozzle arrangement in the print head shown in FIGS. 3A and 3B.

FIG. 6 is a plan view perspective diagram showing an enlarged view of a portion of the ink chamber unit 53 (pressure chamber 52) shown in FIG. 3A.

As shown in FIG. 6, the planar shape of each pressure chamber 52, which is viewed from the upper surface of the print head 50, is substantially a square shape. The nozzle 51 and the ink supply port 54 are formed at respective corners of a diagonal of the planar shape of the pressure chamber 52. On the side of the individual electrode 57 adjacent to the nozzle 51, the electrode pad 59 extends to the outer side of the piezoelectric element 58 (the piezoelectric element-free region where no piezoelectric element 58 is formed; in other words, the region on the partition, which divides the adjacent pressure, chambers 52). The wiring members 60 coupled by the coupling members 64 are formed on the electrode pads 59.

Figure 7:
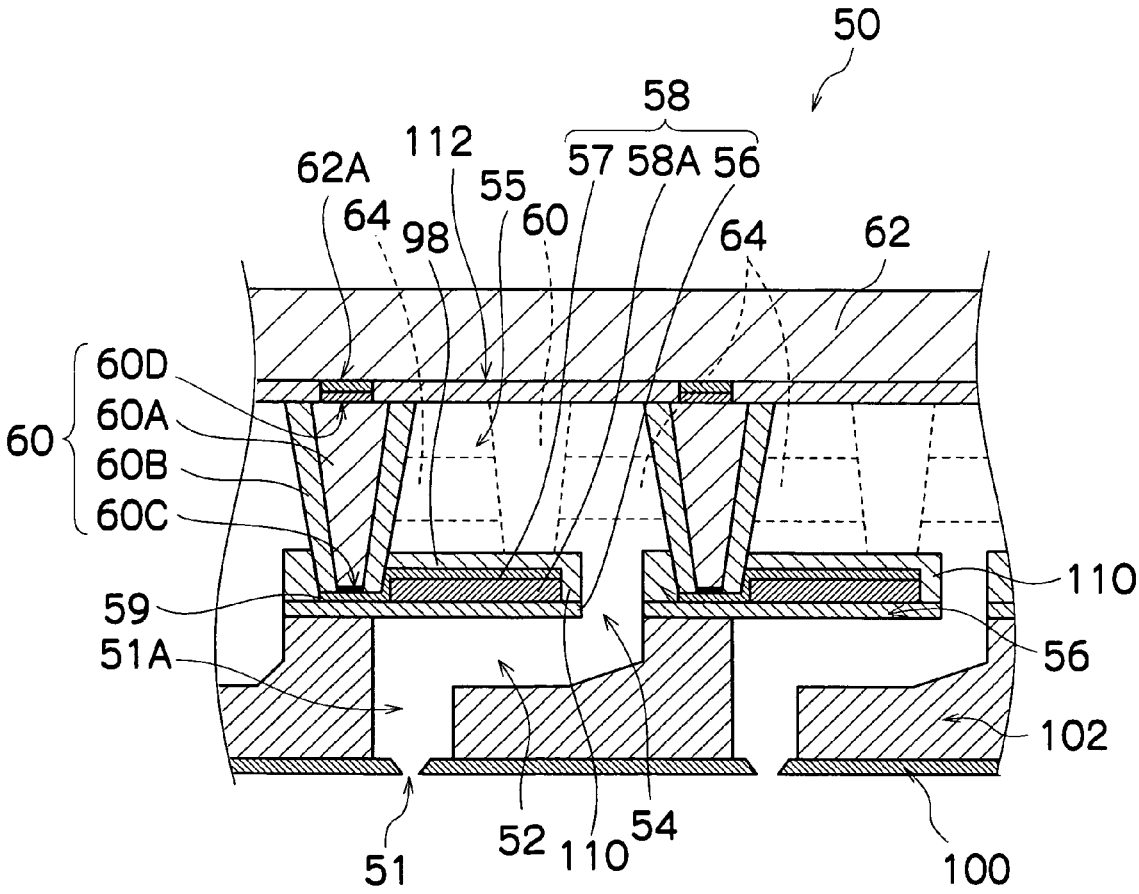
FIG. 7 is a cross-sectional diagram along line 7-7 in FIG. 6.

FIG. 7 is a cross-sectional diagram (along line 7-7 in FIG. 6) showing the three-dimensional structure of an ink chamber unit 53.

As shown in FIG. 7, the print head 50 has a laminated structure in which a plurality of thin films (thin plate-shaped members) are layered together. Below, the thin films forming the respective layers may be referred to as "plates".

A flow channel plate 102 formed with the pressure chambers 52, the supply ports 54, and nozzle flow channels (ejection side flow channels) 51A linking the pressure chambers 52 and the nozzles 51, is layered onto a nozzle plate 100 formed with the nozzles 51. The flow channel plate 102 is depicted as a single plate in FIG. 7, but for example, the flow channel plate 102 may have a laminated structure in which a plurality of plates are layered together, such as an ejection side flow channel plate formed with holes which will form the ejection side flow channels 51A, and a pressure chamber plate formed with openings which will form the pressure chambers 52.

The diaphragm 56 forming the ceiling faces of the pressure chambers 52 is laminated onto the one side of the flow channel plate 102, which is the opposite side from the nozzle plate 100. Opening sections which are to form the supply ports 54 establishing the communication between the pressure chambers 52 and the common liquid chamber 55 are provided in the diaphragm 56, and the pressure chambers 52 are directly communicated with the common liquid chamber 55 formed on the upper side of the diaphragm 56 via the supply ports 54.

A piezoelectric body 58A is formed on the opposite side of the diaphragm 56 from the pressure chamber 52, in a region corresponding to substantially the whole surface of each respective pressure chamber 52. The individual electrode 57 is formed on the opposite side of the piezoelectric body 58A from the diaphragm 56. The piezoelectric body 58A sandwiched between the lower common electrode (diaphragm 56) and the upper individual electrode 57 in this way changes the shape and changes the volume of the pressure chamber 52 when a prescribed voltage (drive signal) is applied between the common electrode (diaphragm) 56 and the individual electrode 57. A piezoelectric element 58, which causes ink to be ejected from the nozzle 51, is composed in this way.

The electrode pad 59 which functions as an electrode connecting section which can extends to the outside of the piezoelectric element 58 is formed on the end of the individual electrode 57 adjacent to the nozzle 51. The column-shaped wiring member 60 is disposed substantially perpendicularly with respect to the electrode pad 59. The flexible substrate 62 which is formed with a plurality of wires corresponding to the respective piezoelectric elements 58 and which constitutes the ceiling of the common liquid chamber 55 is layered on the opposite side of the wiring member 60 from the electrode pad 59.

Each wiring member 60 comprises the conducting member 60A which transmits the drive voltage of the piezoelectric element 58 and the covering member 60B which protects the conducting member 60A and ensures prescribed insulating characteristics. An electrode 60C is formed on the surface that is joined to the electrode pad 59, and an electrode 60D is formed on the surface that is joined to the respective wires of the flexible substrate 62.

In the sections of the wiring member 60 which form the electrodes 60C and 60D, the conducting member 60A is exposed by removing the covering member 60B, and prescribed processing, such as solder plating, metal plating or the like, is carried out on the exposed sections, thereby forming the electrodes 60C and 60D.

A lot of pads 62A in which the respective wires extends are formed in the sections of the flexible substrate 62 which are bonded to the wiring members 60 (electrodes 60D), and these pads 62A are bonded with the electrode 60D of the corresponding wiring member 60 by means of conductive adhesive, solder, or the like. In this way, the wire formed in the flexible substrate 62 can be connected electrically to the individual electrode 57 via the pad 62A, the electrode 60D, the conducting member 60A, the electrode 60C, and the electrode pad 59. Hence, drive voltages are supplied to the individual electrodes 57 of the respective piezoelectric elements 58.

Here, the interior of the common liquid chamber 55 is filled with ink, and therefore, the face of the piezoelectric elements 58 (individual electrodes 57) and the face of the flexible substrate 62 on the side of the common liquid chamber 55 make contact with the ink. Consequently, in order to protect the piezoelectric elements 58 and the flexible substrate 62 from oxidation, corrosion, and the like, by the ink. In order to ensure that the wires provided with the flexible substrate 62 are insulated form the ink, a protective member (protective film) 110 is formed on the liquid contacting section of the piezoelectric element 58 (individual electrode 57), and a protective member (protective film) 112 is formed on the liquid contacting section of the flexible substrate 62. The protective member 110 and the protective member 112 may be made fully or partially from the same material, or they may be made from different members.

Since the common liquid chamber 55, which is located in the related art on the same side of the diaphragm 56 as the pressure chambers 52, is situated on the opposite side of the diaphragm 56 from the pressure chambers 52 as shown in FIG. 7, then there is no requirement for long ink flow channels, or the like, for guiding the ink from the common liquid chamber 55 to the pressure chambers 52, as required in the related art. Furthermore, the size of the common liquid chamber 55 can be increased thereby. Therefore desirable ink supply can be achieved even in the case of a high ejection frequency (short ejection interval), increased density of the nozzles can be achieved, and moreover, the nozzles can be driven at a high ejection frequency even if the nozzles are arranged at a high density.

Furthermore, since the wiring to the individual electrodes 57 of the respective piezoelectric elements 58 rises up perpendicularly from the electrode pads 59 connected electrically to the individual electrodes 57 and passes through the common liquid chamber 55, then it is possible to increase the density of the wiring used to supply drive signals to the piezoelectric elements 58.

Furthermore, since the pressure chambers 52 and the common liquid chamber 55 are disposed on opposite sides of the diaphragm 56 respectively, and the pressure chambers 52 are connected directly to the common liquid chamber 55 via the supply ports 54, then it is possible to create a direct fluid connection between the pressure chambers 52 and the common liquid chamber 55. Moreover, since the length of the ejection side flow channel 51A from the pressure chamber 52 to the nozzle 51 is reduced in comparison with the related art, then even if the nozzles are arranged at high density, high-viscosity ink (for example, approximately 20 cP to 50 cP) can still be ejected and a flow path structure which allows swift refilling after the ejection can be achieved.

Figure 8:
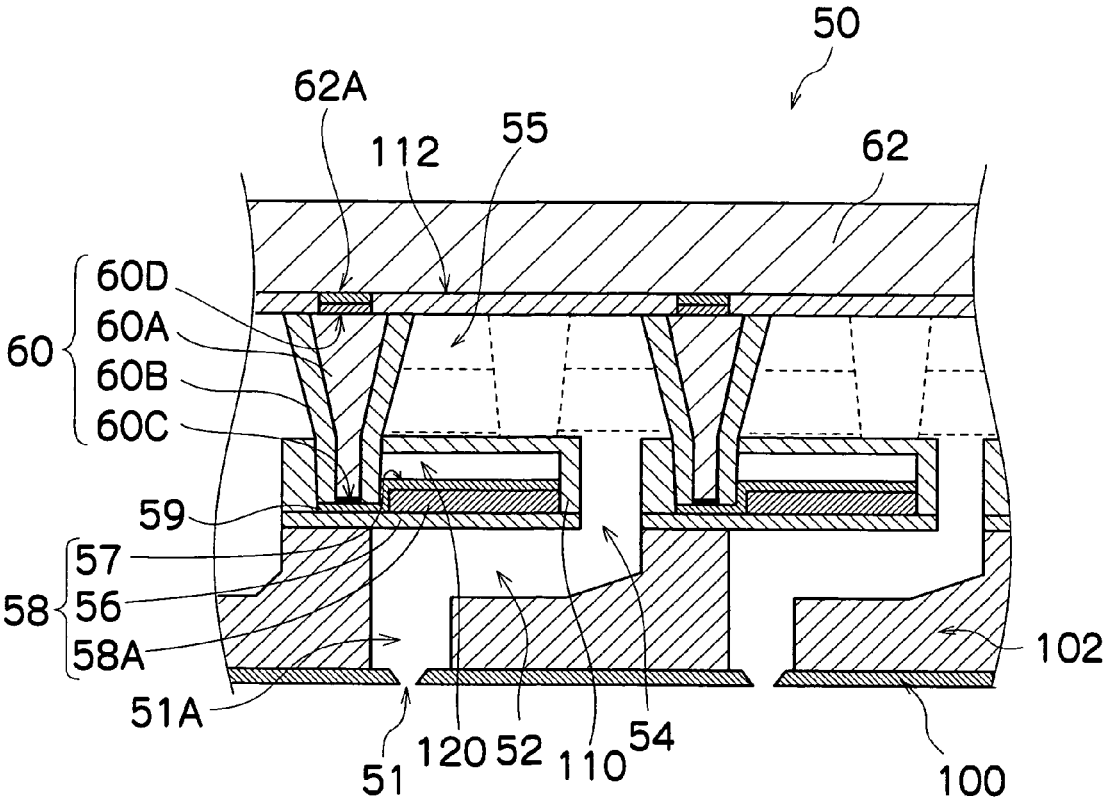
FIG. 8 is a diagram showing one mode of the print head shown in FIG. 7.
Figure 9:
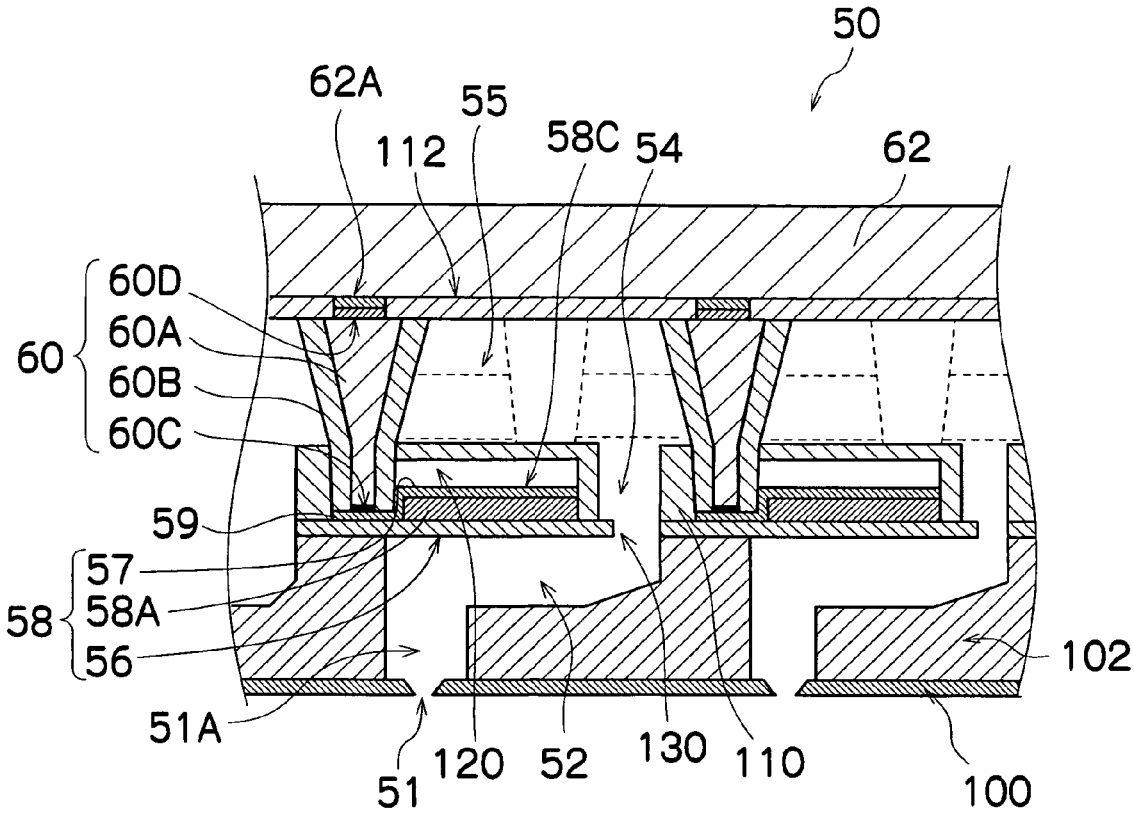
FIG. 9 is a diagram showing a further mode of the print head shown in FIG. 7.

FIG. 8 and FIG. 9 show further modes of the print head 50 shown in FIG. 7. In FIG. 8 and FIG. 9, items which are the same as or similar to those in FIG. 7 are labeled with the same reference numerals and description thereof is omitted here.

In the print head 50 shown in FIG. 8, a low-rigidity section 120 with lower rigidity than that of the protective member 110 is provided between the protective member 110 and the individual electrode 57 on the opposite side of the piezoelectric element 58 from the diaphragm 56.

By providing this low-rigidity section 120, the displacement of the diaphragm 56 is not restricted when the piezoelectric element 58 is driven. Therefore the displacement of the diaphragm 56 is increased compared to the mode shown in FIG. 7, when the piezoelectric element 58 is operated at the same drive voltage. Consequently, improved drive efficiency of the piezoelectric element 58 can be expected.

Air may be used as the low-rigidity section 120 (in other words, the low-rigidity section 120 may be formed as a cavity or gap), or the low-rigidity section 120 may be filled with silicone rubber, resin, or the like.

FIG. 9 shows a further mode of the print head 50 shown in FIG. 7 and FIG. 8. In the mode shown in FIG. 9, a restricting member 130 is provided in the supply port 54, and when ink flows from the pressure chamber 52 into the common liquid chamber 55, the restricting member 130 acts in such a manner that it reduces the size of the supply port 54 compared to a case where the ink flows from the common liquid chamber 55 into the pressure chamber 52. A valve, or the like, may be used as the restricting member 130.

By providing the restricting member 130 shown in FIG. 9, reflux of ink from the pressure chamber 52 into the common liquid chamber 55 is prevented when ink is ejected from the nozzle 51, whereas during refilling where ink is supplied from the common liquid chamber 55 into the pressure chamber 52, the ink flow is facilitated, and desirable ink ejection can be achieved even in cases where ink is ejected at a short ejection interval, or cases where ink of high viscosity compared to general ink is used.

FIG. 9 shows a state of the restricting member 130 during ink ejection time when ink is ejected from the nozzle 51.

Method for Manufacturing Print Head

Next, the method of manufacturing the print head 50 shown in FIG. 7 to FIG. 9 will be described with reference to FIGS. 10A to 10D.

Figure 10A:
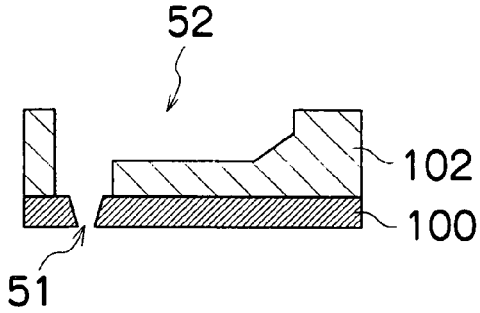
FIGS. 10A to 10D are diagrams showing manufacturing steps for the print head shown in FIG. 1.

Firstly, as shown in FIG. 10A, the pressure chambers 52 are formed. The method of forming the pressure chambers 52 is not limited in particular, but in a certain example, stainless steel plates etched to create open a space which is to form the pressure chamber are laminated, or alternatively, a silicon plate is etched to form a flow channel plate 102 having spaces for forming the pressure chambers 52.

Next, the nozzle plate 100 formed with openings that are to form the nozzles 51, and made of polyimide, for example, is bonded onto the flow channel plate 102 formed with spaces that are to form the pressure chambers 52.

Figure 10B:
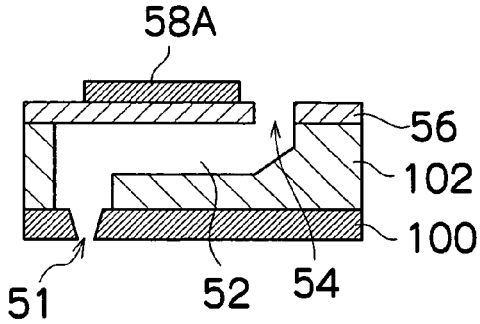

Next, as shown in FIG. 10B, the diaphragm 56 is bonded onto the flow channel plate 102 formed with spaces which are to form the pressure chambers 52. Furthermore, the diaphragm 56 also serves as the common electrode. Openings are provided in the diaphragm 56 in positions corresponding to the pressure chambers 54. Furthermore, the thin film-shaped piezoelectric body 58A is formed by AD (aerosol deposition method), sputtering, or the like, on the opposite face of the diaphragm 56 from the pressure chambers 52, in a section corresponding to each of the pressure chambers 52. The bulk piezoelectric bodies may be formed by grinding. The diaphragm 56 and the piezoelectric bodies 58A are formed to a thickness of approximately 10 μm, for example.

Figure 10C:
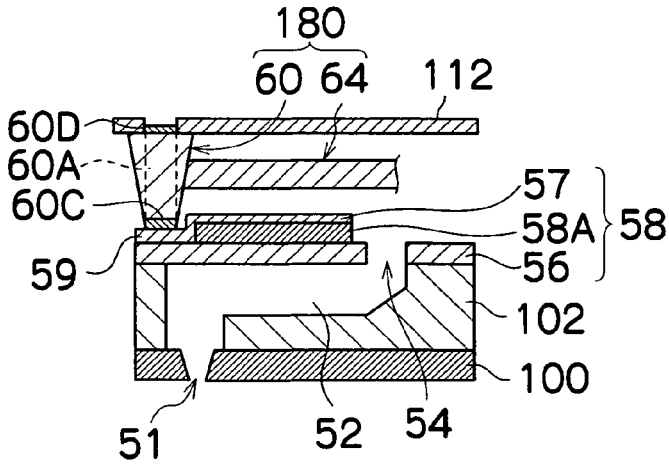

Next, as shown in FIG. 10C, the common liquid chamber 55 is formed.

The individual electrodes 57 are formed (bonded) by sputtering, vapor deposition, or the like, onto the opposite surface of the piezoelectric bodies 58A from the diaphragm 56, the piezoelectric bodies 58A being formed on the opposite surface of the diaphragm 56 from the pressure chambers 52. A portion of the individual electrodes 57, such as the end adjacent to the nozzle 51, extends to the outside of the piezoelectric body 58A and formed into the electrode pad 59 for connecting wires.

On the other hand, a wiring member module is formed by joining a wiring member group 180 to the protective member 112 shown in FIG. 7 to FIG. 9, the wiring member group 180 including the plurality of the wiring members 60 coupled by means of the coupling members 64. The electrodes 60C provided on the front end of the respective wiring members 60 are joined to the electrode pads 59 by means of a conductive adhesive. If a protective film is formed on the liquid-contacting sections of the flexible substrate 62, then the wiring member group is bonded to the flexible substrate 62 (after the protection film formation processing) on which the protective film has been formed.

Moreover, a protective member 112 (flexible substrate 62) is attached to the member (not shown) which is to form the side walls of the common liquid chamber 55. The common liquid chamber 55 is formed by taking the wiring members 60 as columns, the diaphragm 56 as the floor, and the protective member 112 (flexible substrate 62) as the ceiling.

After the common liquid chamber 55 is formed by bonding the protective member 112 formed with the wiring members 60 onto a plate formed with piezoelectric elements 58 constituted by piezoelectric bodies 58A sandwiched between a diaphragm 56 (common electrode) and an individual electrode 57 provided on a pressure chamber 52, an insulating/protective film is formed onto sections (liquid-contacting sections) of the diaphragm 56 and the piezoelectric elements 58 which make contact with the ink in the common liquid chamber 55, though this is not shown in the diagram.

Figure 10D:
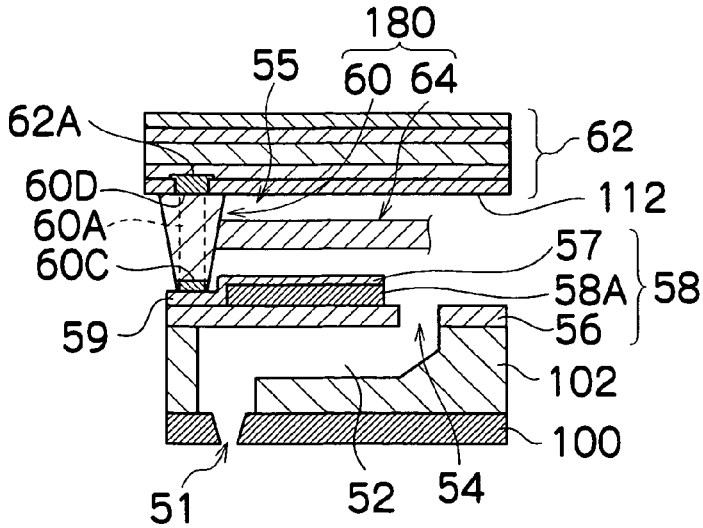

Finally, in FIG. 10D, a multi-layer flexible cable 62 is bonded onto the opposite side of the protective member 112 from the wiring members 60, thereby forming the print head 50. A conductive adhesive is used for bonding the electrodes 60D of the wiring members 60 with the pads 62A of the flexible substrate 62. Furthermore, desirably, the multi-layer flexible substrate 62 comprises at least four or more layers.

If a protective film is formed on the liquid-contacting sections of the flexible substrate 62, then the process shown in FIG. 10D is omitted.

Method of Manufacturing Wiring Members and Coupling Members

Next, the method of manufacturing (bonding) the wiring members 60 and the coupling members 64 described above will be explained.

Figure 11:
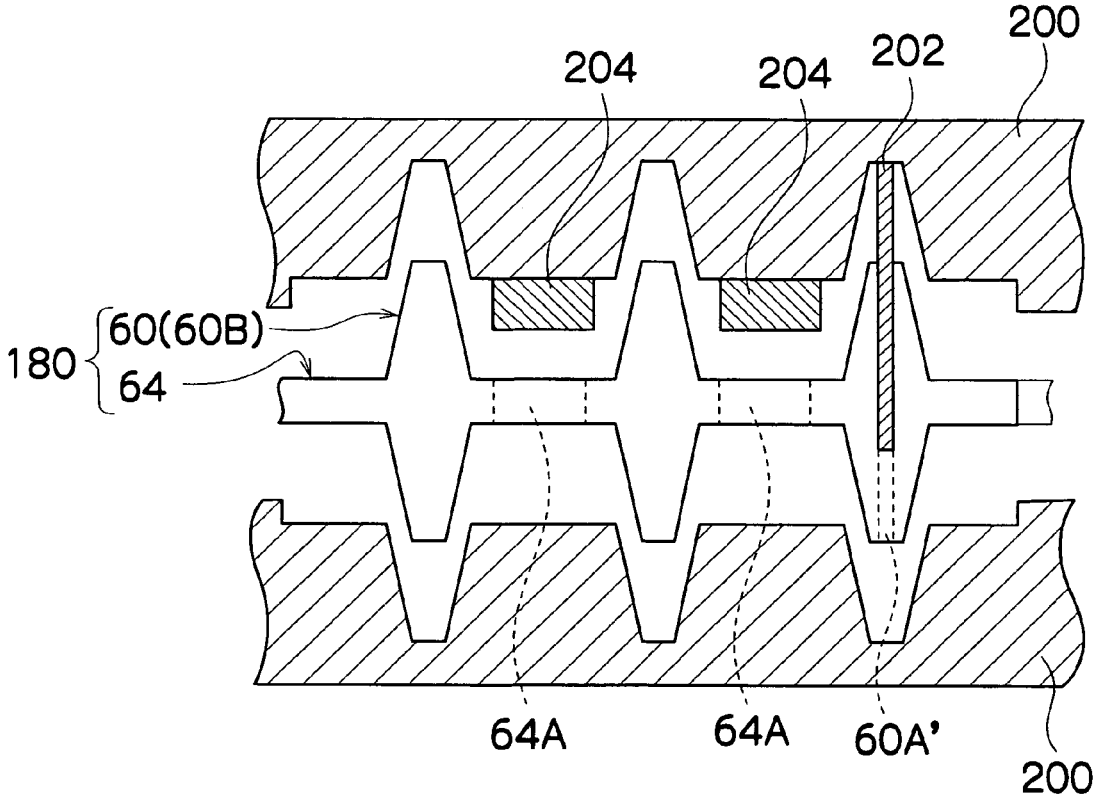
FIG. 11 is a diagram showing one example of a method of manufacturing the wiring members shown in FIG. 4.

FIG. 11 is a diagram showing a method of manufacturing a wiring member group 180 comprising the wiring members 60 and the coupling members 64.

As described previously, the wiring members 60 each comprise a conducting member 60A which transmits a drive voltage to be supplied to a piezoelectric element 58, and a covering member 60B which protects the conducting member 60A and ensures insulation between the conducting member 60A and the ink inside the common liquid chamber 55. Furthermore, both the covering members 60B and the coupling members 64 are made from resin.

As shown in FIG. 11, the covering members 60B (column sections) of the wiring members 60 and the coupling members 64 (coupling sections) are formed at once by means of a mold (matching mold) 200. Through holes 60A' are formed at once by means of pins 202, in the sections of the wiring members 60 where the conducting members 60A are to be formed.

Instead of using the pins 202, it is also possible to use post-processing, such as laser machining, to form the through holes 60A' where the conducting members 60A are to be formed.

When a wiring member group 180 is formed in this way, the wiring members 60 are coupled together and the wiring members 60 and the coupling members 64 that join these wiring members 60 are formed in an integrated fashion.

Therefore, the bonding strength is increased compared to a case where the wiring members 60 and the coupling members 64 are formed separately and then bonded together by adhesive or the like.

Since the wiring members 60 and the coupling members 64 are formed in an integrated manner using the mold 200, positioning is carried out in a fewer number of locations than the number of wiring members 60, and all of the wiring members 60 inside the common liquid chamber 55 can be positioned with good accuracy.

Moreover, since the covering members 60B and the coupling members 64 are made of the same material (the same elements and composition), then strength is improved compared to a case where they are made from different materials, and it is also possible to prevent separation (breakage) due to differences in the coefficient of thermal expansion when the members are heated (during heat treatment).

The reference numeral 64A marked by the broken line in FIG. 11 indicates a cavity section which is surrounded by the coupling members 64 (a section where ink is present inside the common liquid chamber 55), and the reference numeral 204 indicates a projecting section in the mold 200 which corresponds to the cavity section 64A.

FIG. 11 shows a mode where the wiring member group 180 is formed in an integrated manner by integral forming using resin in the mold 200, but as a method of forming the wiring member group 180 in an integrated manner, it is also possible to adopt lamination of thin metal plates of stainless steel, or the like, or silicon processing (a method which combines anisotropic etching and isotropic etching).

As shown in FIG. 11, if the wiring members 60 are formed using a mold (matching mold) 200, then the shape of the wiring members 60 has vertical symmetry in FIG. 11. Furthermore, if the wiring members 60 are formed by laminating or silicon processing, then it is possible to form the wiring members 60 having various shapes. Hereinafter, the wiring members 60 may be indicated as substantially circular column-shaped members.

Furthermore, it is also possible to form the wiring members 60 and the coupling members 64 separately and to then bond them together, thereby forming a wiring member group 180. In this case, the bonding strength is reduced compared to integral forming, and there is a possibility that bonding accuracy declines (manufacturing variations will increase) and the number of manufacturing steps also increases. Consequently, it is desirable to form the wiring members 60 and the coupling members 64 in an integrated fashion.

Arrangement of Wiring Members

Figure 12:
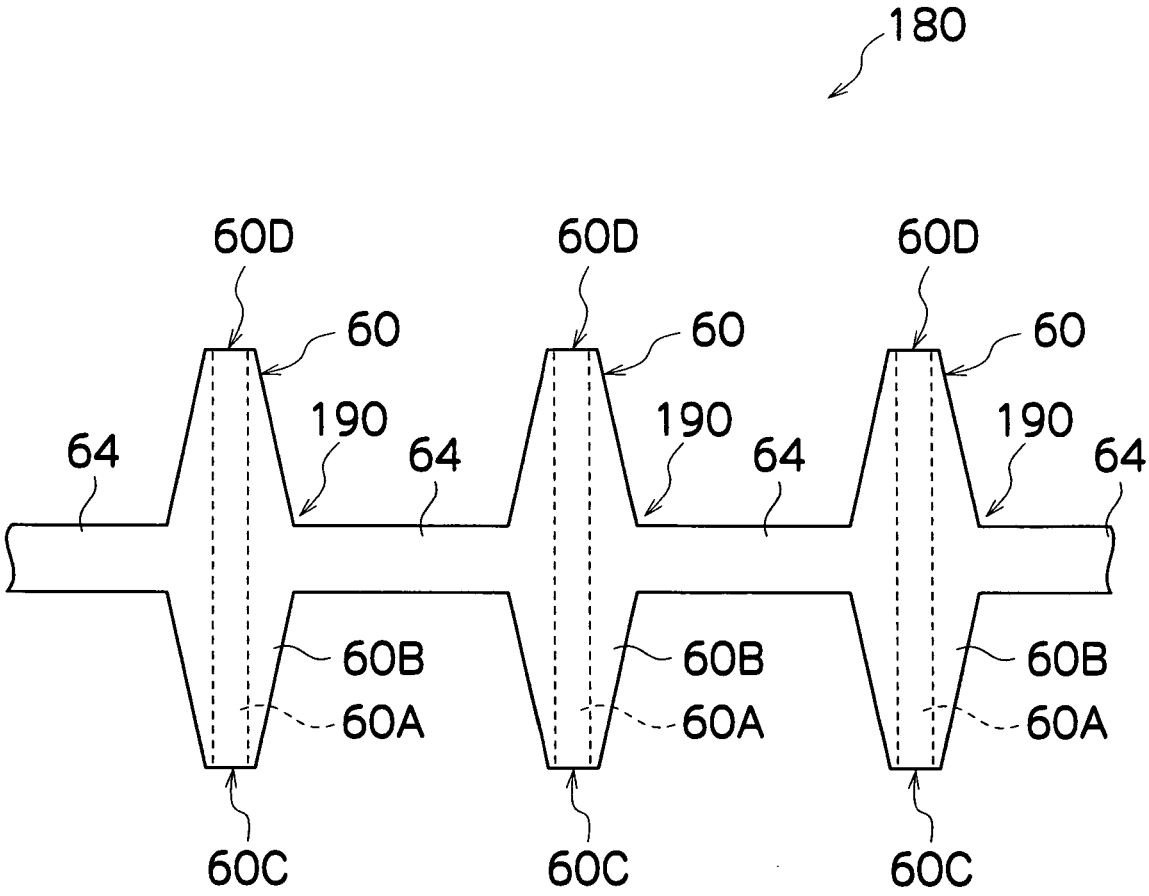
FIG. 12 is a diagram showing the structure of the wiring members and the coupling members shown in FIG. 4.

FIG. 12 is a side diagram of the print head 50 viewed from the side, which shows three wiring members 60 of the plurality of wiring members 60 formed inside the common liquid chamber 55.

As shown in FIG. 12, the wiring members 60 have formation positions (coupling positions) 190 for the coupling members 64, at approximately the center point thereof in the height direction (at a position that is approximately equidistant from either end). The wiring members 60 shown in FIG. 12 have a symmetrical shape with respect to the coupling members 64, whereby they have greatest thickness in the vicinity of the coupling positions 190, and are thinnest in the vicinity of the respective ends where the electrodes 60C and 60D are formed.

Figure 13:
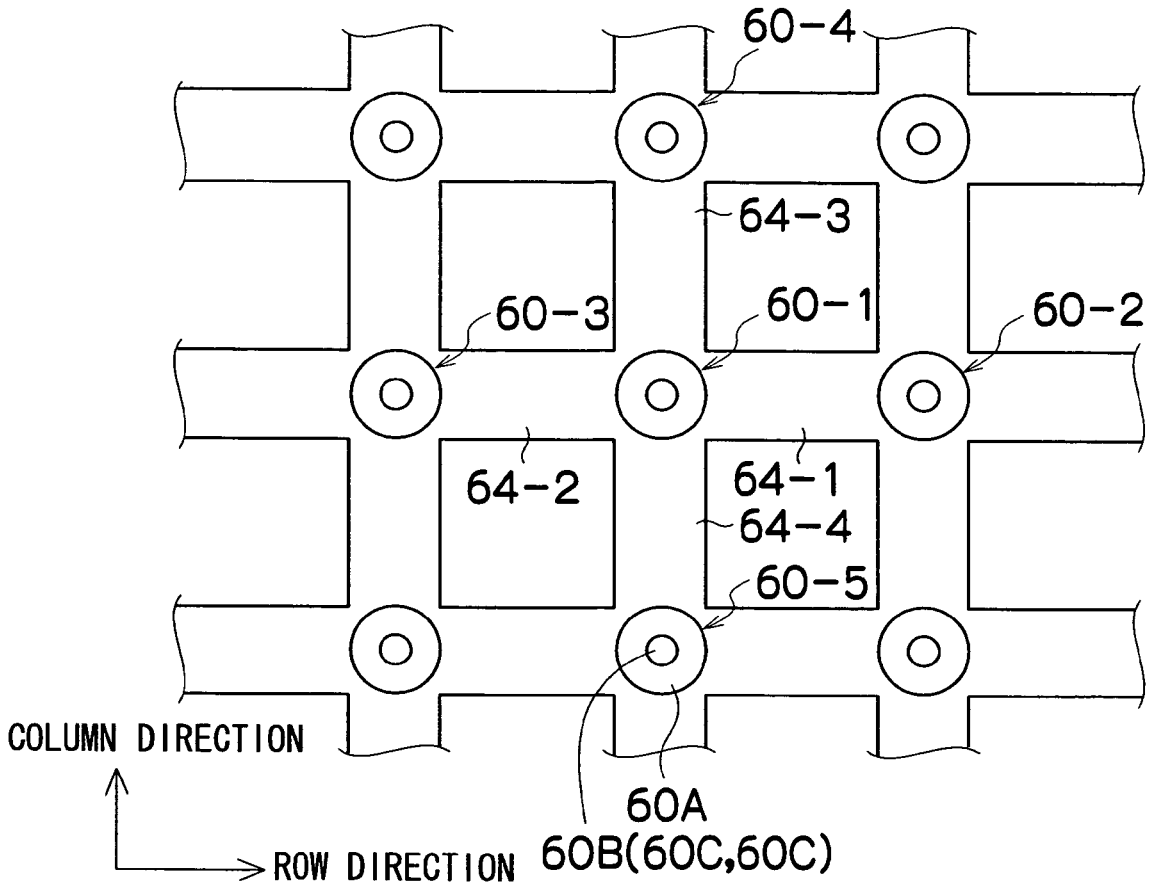
FIG. 13 is a plan diagram showing an arrangement of the coupling members shown in FIG. 4.

FIG. 13 is a plan diagram showing the wiring members 60 and the coupling members 64 shown in FIG. 12 as viewed from the diaphragm 56 side (the lower surface side) or the flexible substrate 62 side (the upper surface side). As shown in FIG. 13, the wiring members 60 are disposed two-dimensionally so as to correspond to the piezoelectric elements 58 provided inside the common liquid chamber 55 (so as to correspond to the ink chamber units 53). The respective wiring members 60 are coupled with wiring members 60 that are adjacent in the row direction and the column direction, by means of the coupling members 64.

For example, the wiring member 60-1 is coupled to the wiring members 60-2 and 60-3 that are adjacent in the row direction by means of the coupling members 64-1 and 64-2, and is coupled to the wiring members 60-4 and 60-5 that are adjacent in the column direction by means of the coupling members 64-3 and 64-4.

In other words, in the mode shown in FIG. 13, the wiring members 60 arranged in a two-dimensional fashion in the row direction and column direction have the four coupling members 64 formed respectively on either side in the row direction and on either side in the column direction.

In the mode shown in FIG. 13, since each wiring member 60 is formed with the wiring members 60 which are adjacent to same on either side in the row direction and either side in the column direction, by means of the coupling members 64, then it is possible to improve the strength and the positional accuracy of the wiring members 60.

Figure 14A:
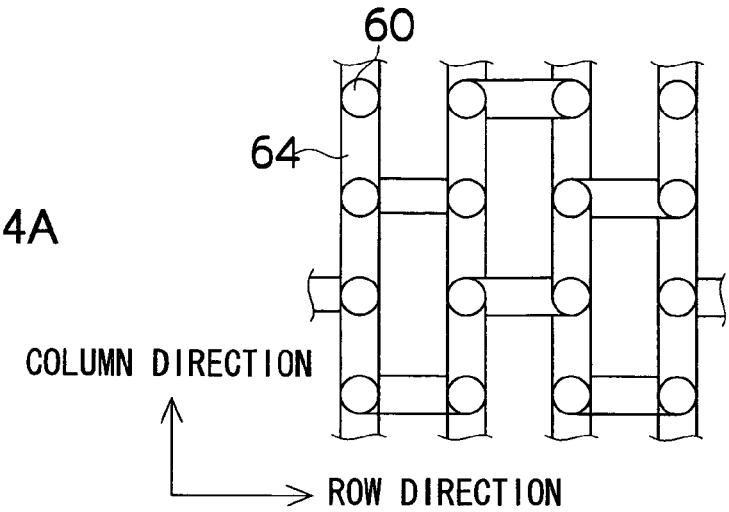
FIGS. 14A to 14C are diagrams showing one mode of arranging the coupling members shown in FIG. 13.

As shown in FIG. 14A, it is also possible to adopt a structure (non-coupled structure) in which the wiring members 60 are not bonded to the coupling members in the row direction or the column direction.

More specifically, the wiring members 60 arranged in the column direction are alternately connected to the wiring members located adjacently in the opposite directions, by means of the coupling members 64. Thus, the coupling members 64 that join the wiring members 60 with each other in the row direction, at every other wiring member 60 arranged in the column direction, extend in the same row direction. Consequently, each of the wiring members 60 is connected with the two or three coupling members 64.

In the mode shown in FIG. 14A, the number of coupling members 64 arranged in the common liquid chamber 55 is reduced in comparison with the mode shown in FIG. 13, and therefore the flow path resistance inside the common liquid chamber 55 can be reduced. Moreover, desirably, the coupling members 64 are arranged by taking account of the expulsion of air bubbles.

Figure 14B:
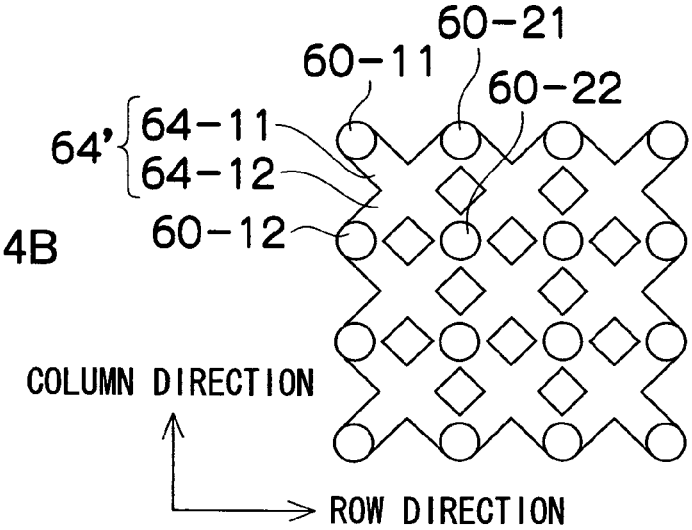

In the mode shown in FIG. 14B, the wiring members 60 that are mutually adjacent in the oblique direction are coupled by means of the coupling members 64. For example, the wiring member 60-11 is coupled to the wiring member 60-22 that is adjacent in the oblique direction by means of the coupling member 64-11, and the wiring member 60-12 is coupled to the wiring member 60-21 that is adjacent in the oblique direction by means of the coupling member 64-12. Moreover, the coupling member 64-11 and the coupling member 64-12 are bonded together at the approximate center points thereof.

In other words, the four wiring members 60-11, 60-12, 60-21 and 60-22 positioned at the apices of a substantial square shape are coupled together by means of a coupling plate 64' (a coupling member formed by joining together the coupling members 64-11 and 64-12 shown in FIG. 14B) having an approximate cross shape in plan view observed from the upper face side.

Figure 14C:
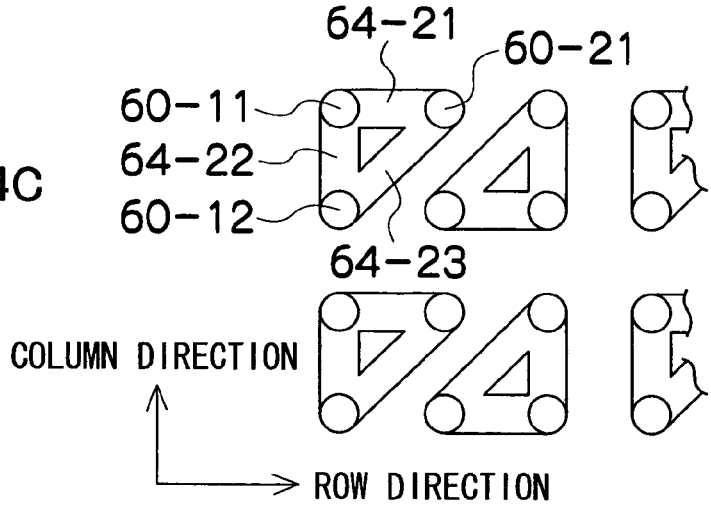

Furthermore, as shown in FIG. 14C, the three wiring members 60-11, 60-12, and 60-13 may be coupled by means of the three coupling members 64-21, 64-22 and 64-23. In other words, as shown in FIG. 14C, it is also possible to use a suitable combination of the coupling members 64 in the row direction, column direction, and oblique directions. FIG. 14C shows a mode in which the three wiring members 60 that are mutually adjacent are coupled by means of the three coupling members 64, but the number of wiring members coupled together may be four or more.

Figure 15:
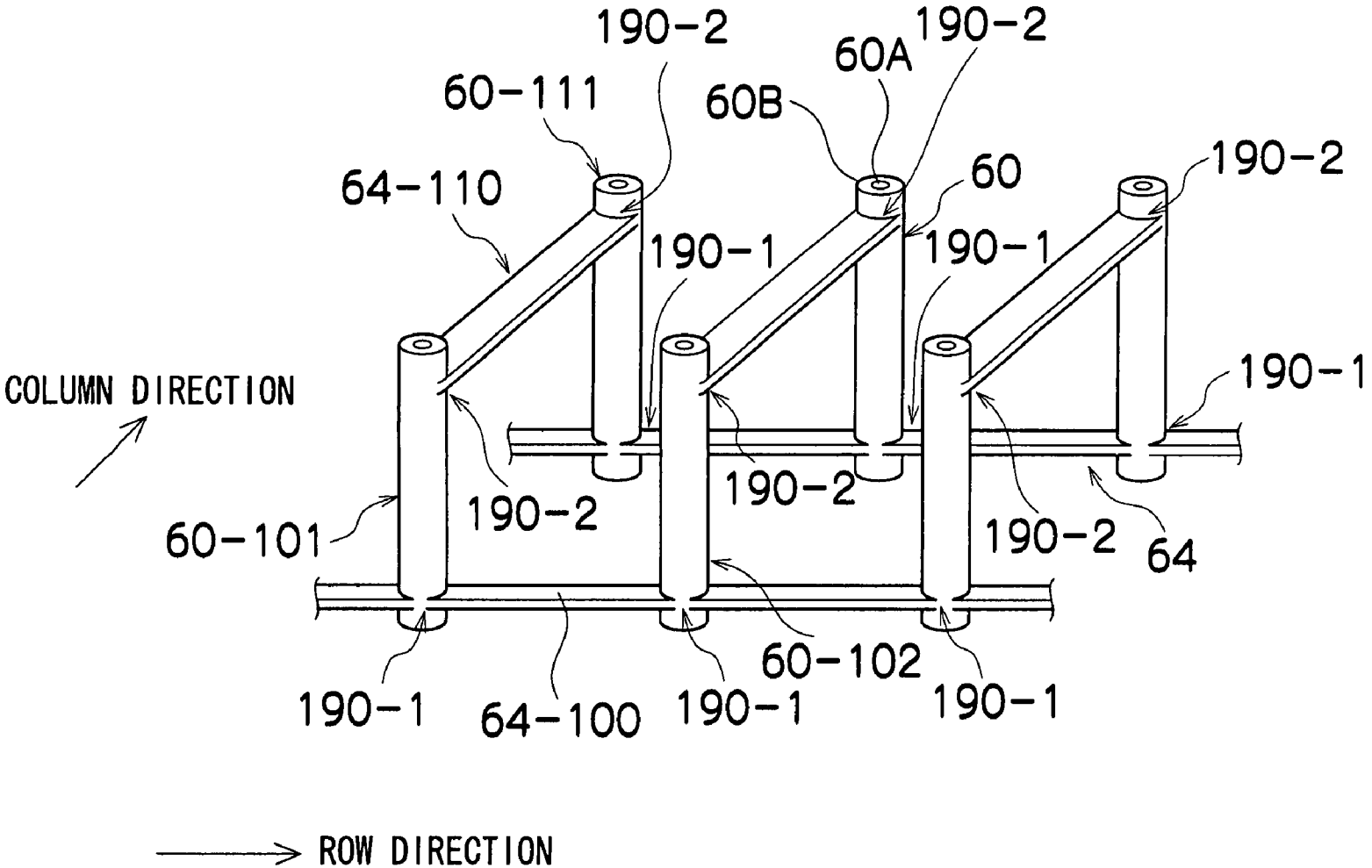
FIG. 15 shows a further mode of arranging the coupling members shown in FIG. 13.

FIG. 15 shows a mode in which the coupling position (height) 190-1 at which the wiring members 60 (for instance, wiring member 60-101 and wiring member 60-102) that are mutually adjacent in the row direction are coupled together is different from the coupling position (height) 190-2 at which the wiring members 60 (for instance, wiring member 60-101 and wiring member 60-110) that are mutually adjacent in the column direction are coupled together.

As shown in FIG. 15, the coupling members 64-100 in the row direction are coupled at coupling positions 190-1 in the vicinity of the lower end sections of the wiring members 60-101 and 60-102 in FIG. 15, whereas the coupling members 64-110 in the column direction are coupled at coupling positions 190-2 in the vicinity of the upper end sections of the wiring members 60-101 and 60-110 in FIG. 15.

More specifically, in the mode shown in FIG. 15, the coupling positions 190-1 and the coupling position 190-2 of the wiring members 60 are at different heights, and therefore, the coupling members 64 aligned in the row direction and the coupling members 64 aligned in the column direction are provided at different heights. Thus, the ink flow path can be ensured, the flow path resistance inside the common liquid chamber 55 is reduced, and the strength (rigidity) of the print head is maintained since the number of coupling members 64 remains unchanged.

Figure 16:
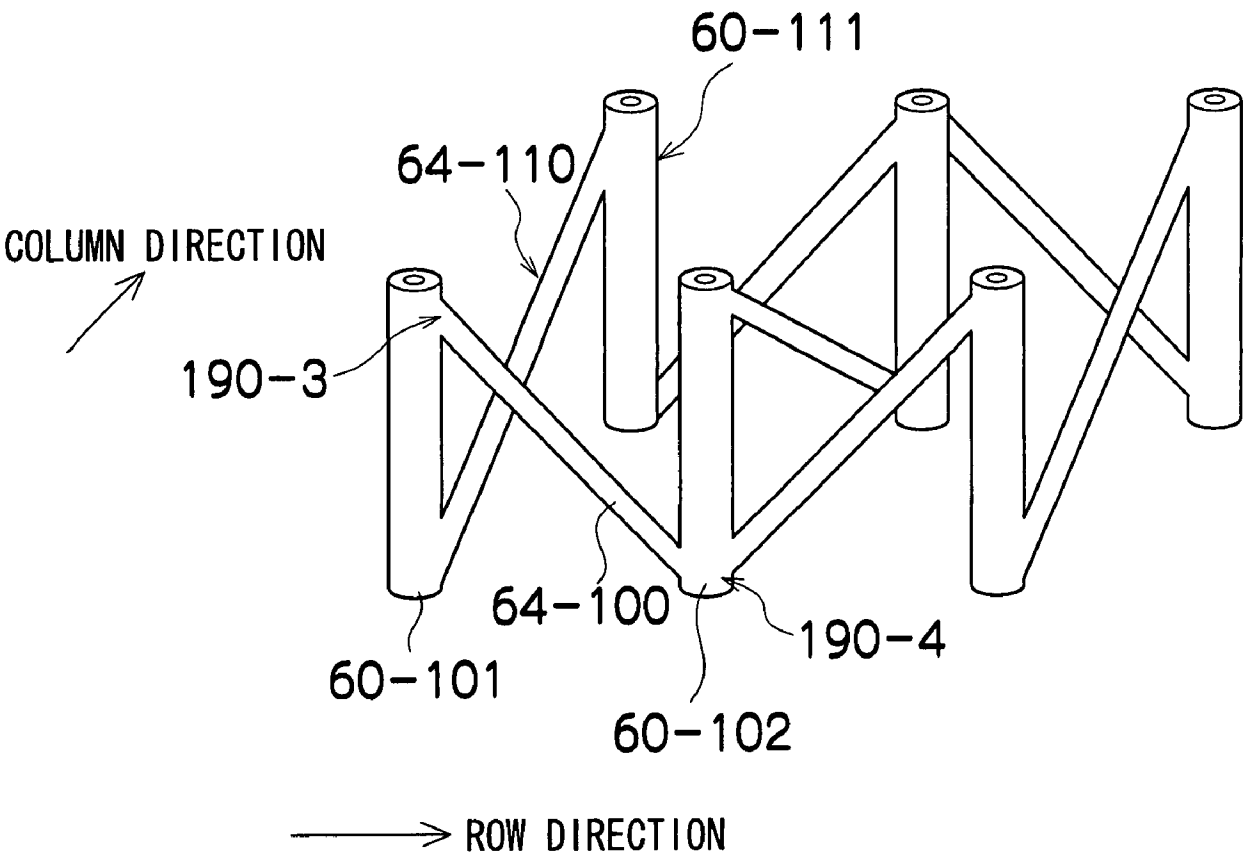
FIG. 16 shows a further mode of arranging the coupling members shown in FIG. 13.

Furthermore, as shown in FIG. 16, two wiring members 60-101 and 60-102 that are coupled by the coupling member 64 may have coupling positions 190-3 and 190-4 at different heights. In other words, in the wiring member 60-101 and the wiring member 60-102 coupled by the coupling member 64-100, the wiring member 60-101 has a coupling position 190-3 at the upper end section in FIG. 16, whereas the wiring member 60-102 has a coupling position 190-4 at the lower end section in FIG. 16.

In other words, in the mode shown in FIG. 16, the coupling members 64 are formed in an oblique direction that is different from a direction substantially perpendicular to the wiring members 60. In the mode shown in FIG. 15, the coupling members 64 are formed in a direction that is substantially perpendicular to the wiring members 60 (a direction substantially parallel to the surface on which the wiring members 60 are provided).

Figure 17:
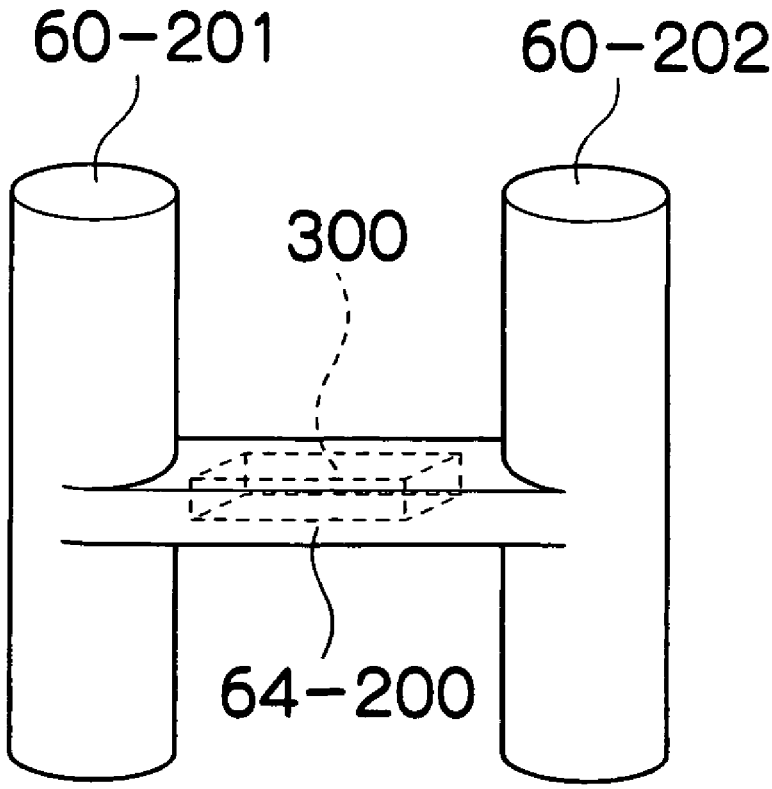
FIG. 17 is a diagram showing a coupling member having a damping effect.

In the mode shown in FIG. 17, a coupling member 64-200 which couples the wiring members 60-201 and 60-202 that are mutually adjacent in the row direction or the column direction is provided with a cavity section 300 indicated in the coupling member 64-200 by the dotted line.

This cavity section 300 functions as a damper for the ink (pressure wave) inside the common liquid chamber 55. Thus, the cavity section 300 makes it possible to reduce cross-talk during ejection, to suppress transient phenomena (vibrations) caused by the pressure wave in the ink inside the common liquid chamber 55 during ejection or refilling, and to maintain ejection at high frequency.

In particular, a coupling member 64 having the cavity section 300 is more effective if it is positioned in the vicinity of a supply port 54. More specifically, desirably, the cavity sections 300 are provided in the coupling members 64 positioned in the vicinity of the supply ports 54 so as to function as dampers, whereas the cavity sections 300 are not provided in the coupling members 64 in other positions so as to maintain strength.

If a low-rigidity member having a lower rigidity than that of the coupling member 64 is filled into the cavity section 300, then it is possible to achieve damping effects and good strength, simultaneously.

In order to form cavity sections 300, projections corresponding to the cavity sections 300 are provided in the mold 200 shown in FIG. 11, thereby forming openings. After that, films are formed on the surface of the coupling member 64 so as to cover these openings. The protective film formed in liquid-contact treatment (liquid resistance treatment) may be used as the film that covers the openings.

FIG. 17 shows a mode in which one cavity section 300 is formed in the approximate center region of the coupling member 64, but it is also possible to form the cavity section 300 in a position other than the approximate center region of the coupling member 64. Furthermore, it is also possible to form a plurality of cavity sections 300 in the coupling member 64.

Figure 18:
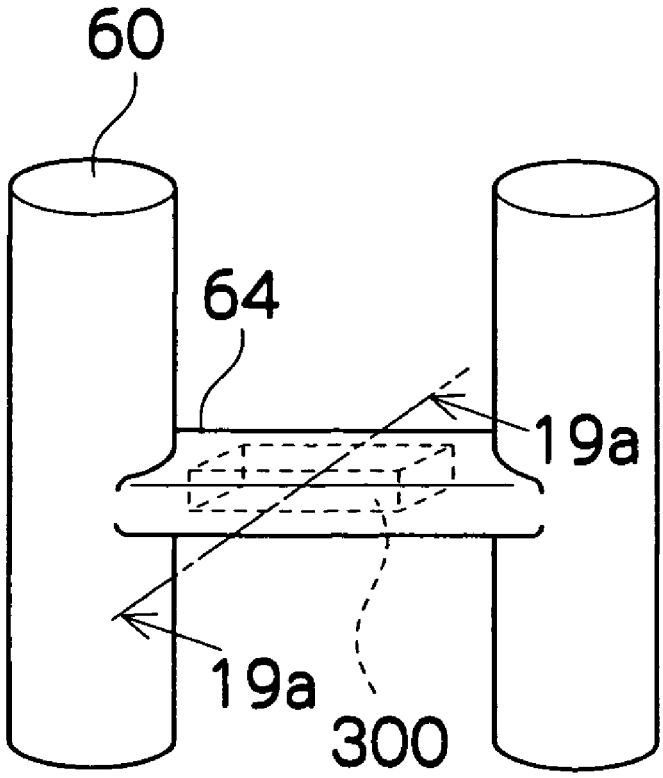
FIG. 18 is a diagram showing one mode of the coupling member shown in FIG. 17.

Moreover, as shown in FIG. 18, desirably, the surfaces of the coupling members 64 are chamfered. By chamfering the coupling members 64 to be chamfered shape, the flow path resistance based on the coupling members 64 is reduced, and the air bubble expulsion characteristics in the common liquid chamber 55 are improved.

Figure 19A:
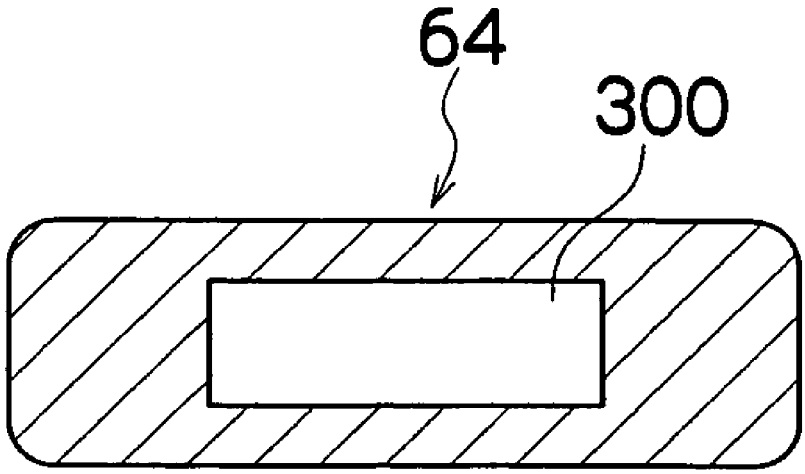
FIGS. 19A and 19B are cross-sectional diagrams along lines 19A-19A in FIG. 18.
Figure 19B:
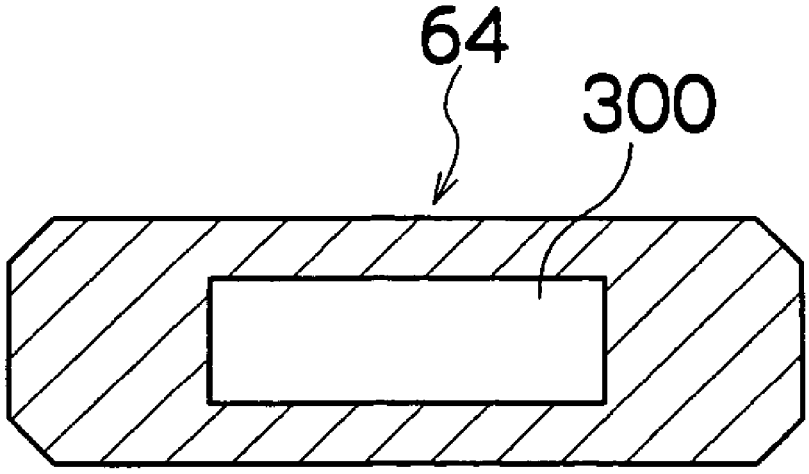

FIGS. 19A and 19B show a cross-sectional diagram along line 19-19 in FIG. 18 (a cross-section in the width direction of the coupling member 64). The chamfering described above involves using a radius shape as shown in FIG. 19A or a cutaway shape as shown in FIG. 19B. Furthermore, by grinding, or the like, it is possible to adopt a shape in which the angle of each apex is further enlarged.

More specifically, the coupling member 64 may be formed in such a manner that the respective apex angles of the cross-sectional shape in a cross-section along the width direction of the coupling member 64 shown in FIGS. 19A and 19B are angles greater than 90° (obtuse angles).

A chamfered shape of this kind can be formed readily by using the mold 200 as shown in FIG. 11. It is also possible to use a mechanical process such as grinding or cutting, or a chemical process such as chemical grinding.

FIGS. 19A and 19B show the coupling member 64 having a substantially quadrilateral cross-sectional shape, but more desirably, a substantially circular shape, a substantially elliptical (oval) shape, or the like, is adopted for the cross-section of the coupling member 64.

Moreover, in order to improve the expulsion of air bubbles from the common liquid chamber 55, desirably, an ink-attracting treatment (a treatment for an affinity for ink) is given on the surfaces (the liquid-contacting sections) of the wiring members 60 and the coupling members 64.

Modification Example

Next, a modification of the present embodiment will be described.

Figure 20:
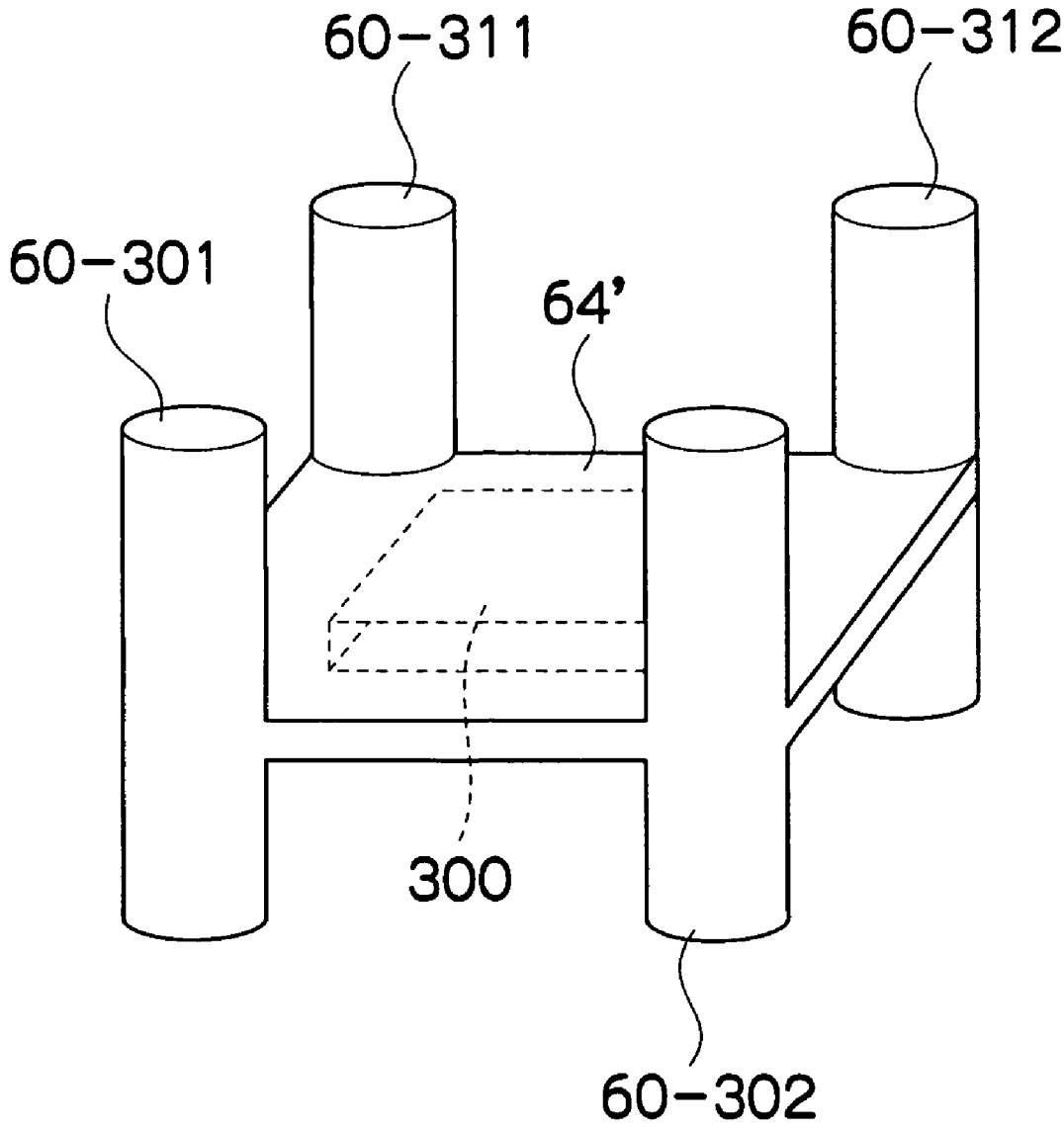
FIG. 20 is a diagram for describing a modification of the coupling member shown in FIG. 4.

FIG. 20 shows a flat plate-shaped coupling member (coupling plate) 64'. As shown in FIG. 20, the coupling member 64' has a substantially square planar shape, taking the respective wiring members 60-301, 60-302, 60-311 and 60-312 as apices, and it is formed substantially in parallel with the diaphragm 56 and the flexible substrate 62 shown in FIG. 4, and other drawings.

In other words, instead of providing the four bar-shaped coupling members 64 which respectively couple together the four adjacent wiring members 60-301, 60-302, 60-311 and 60-312 shown in FIG. 4 and other drawings, these four adjacent wiring members 60-301, 60-302, 60-311 and 60-312 are coupled together by means of a flat plate-shaped coupling plate 64'.

By using the coupling plate 64' shown in FIG. 20, the bonding strength between the wiring members 60 and the coupling plate 64' is increased and the strength of the print head 50 is also increased, in comparison with a case where the wiring members 60 are coupled by means of the bar-shaped coupling members 64.

As shown in FIG. 20, it is also possible to adopt a composition in which a cavity section 300 is provided in the plate-shaped coupling plate 64', so as to function as a damper.

The size of the coupling plate 64' is not limited to a size that can achieve the coupling with four wiring members 60. For example, if the planar shape of the coupling plate 64' is taken to be a substantially square shape, then it may be of a size that can achieve the coupling with 9 wiring members 60 (a size corresponding to the joining together of four of the coupling plates 64' shown in FIG. 20), or a size that can achieve the coupling with 13 wiring members 60 (a size corresponding to the joining together of nine of the coupling plates 64' shown in FIG. 20). Furthermore, the planar shape is not limited to being a substantially square shape, and it may also be a quadrilateral shape other than a square shape, such as a rectangular shape, or various other shapes, such as a triangular shape, pentagonal shape, or other polygonal shape, or a circular or elliptical shape.

Here, if the coupling plate 64' is provided over the full area where the wiring members 60 are provided, then the ink becomes unable to flow in the vertical direction inside the common liquid chamber 55, and therefore, a free disposal region is provided where no coupling plate 64' is disposed.

Figure 21:
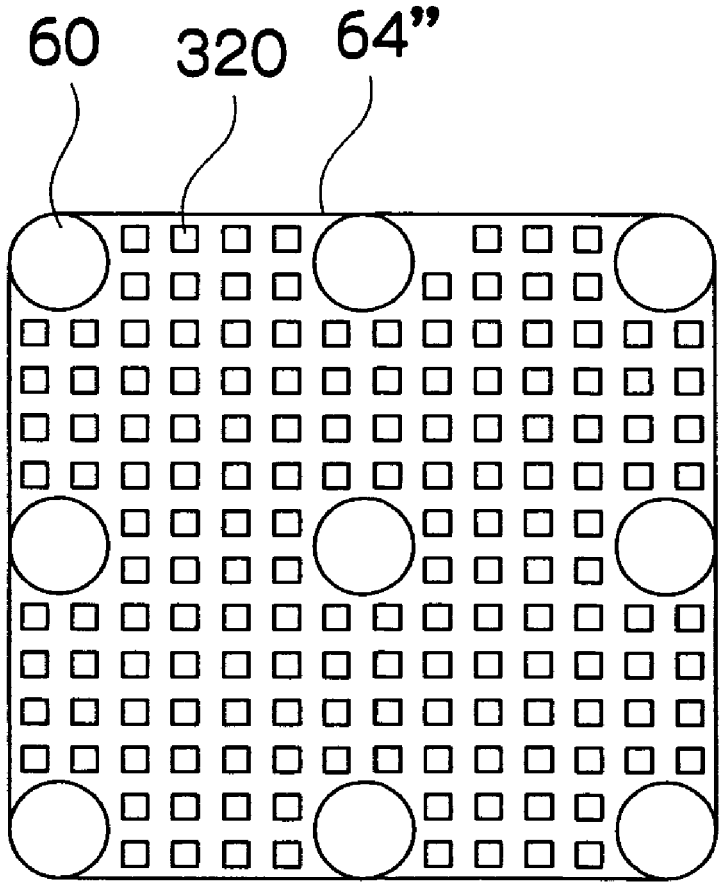
FIG. 21 is a diagram showing one mode of the modification shown in FIG. 20.

FIG. 21 shows a mode where a plurality of small through holes 320 are provided in a coupling plate 64" having a size corresponding to four of the coupling plates 64' shown in FIG. 20, which are joined together. FIG. 21 is a plan view perspective diagram of the interior of the common liquid chamber 55 as observed from the flexible substrate 62 side (or the diaphragm 56 side). A plurality of through holes 320 that pass through the coupling plate 64" in the thickness direction (the direction passing through the plane of the paper in FIG. 21) are arranged two-dimensionally in the coupling plate 64".

Furthermore, in the mode shown in FIG. 21, the through holes 320 have a substantially quadrilateral shape in which the length of each side is in the range of several ten μm to several hundred μm.

By providing the through holes 320 in the coupling plate 64" in this way, it is possible to trap air bubbles, foreign matter, and ink which has increased in viscosity or solidified, in the coupling plate 64". In other words, the coupling plate 64" provided with the through holes 320 functions as a filter inside the common liquid chamber 55.

The size of the through holes 320 is decided according to the size of the air bubbles, the size of foreign matter, and the like, and it is set, for example, to the substantially same size as the size (cross-sectional area) of the nozzles 51.

The planar shape of the through holes 320 is not limited to a substantially square shape, and it may also be a quadrilateral shape other than a square shape, such as a rectangular shape, or various other shapes such as a triangular shape, pentagonal shape, or other polygonal shape, or a circular or elliptical shape. The number of through holes 320 is decided by taking account of the flow path resistance in the common liquid chamber 55 and the strength of the holes.

Moreover, FIG. 21 shows a mode in which the plurality of the through holes 320 with the same size are formed inside one coupling plate 64", but it is also possible to provide the through holes 320 with different sizes inside one coupling plate 64".

Figure 22:
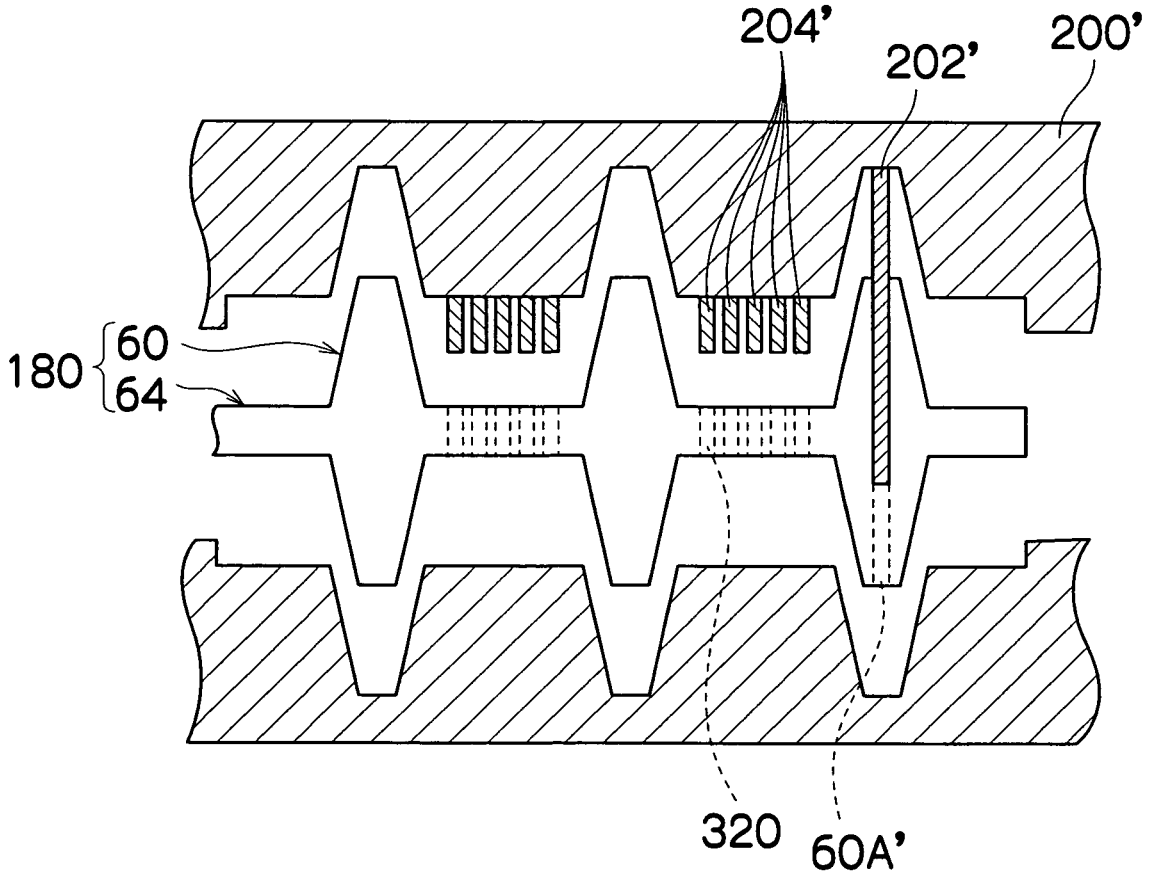
FIG. 22 is a diagram showing one example of a method of manufacturing the wiring members shown in FIG. 21.

FIG. 22 is a diagram showing a manufacturing method in a case where the wiring members 60 and the coupling plate 64" shown in FIG. 21 are formed in an integrated fashion by using a resin material.

As shown in FIG. 22, projecting sections 202' for forming the conducting members 60A of the wiring members 60 and projecting sections 204' corresponding to the through holes 320 are provided in a mold (matching mold) 200'. It is possible to form the wiring members 60 and the coupling plate 64" having the through holes 320 in an integrated fashion by unified forming of resin material using a mold 200' having a shape of this kind, and therefore, the number of manufacturing steps can be reduced.

It is also possible to form a coupling plate 64" in which no through holes 320 are formed, and to then form the through holes 320 by post-processing. It is also possible to form a film which covers the through holes 320 on the surface of a portion (or the whole) of the region where the through holes 320 are formed, thereby creating cavity sections 300 as shown in FIG. 20. In other words, it is possible to achieve both a filter function and a damper function in the coupling plate 64".

As described above, the shape (size), structure, and number of the coupling members 64 (coupling plates 64', 64") is decided on the basis of the flow path resistance of the common liquid chamber 55, the strength of the common liquid chamber 55, and the strength conditions for the whole print head. More specifically, the flow path resistance of the common liquid chamber 55 is decided on the basis of conditions such as the type of ink that is expected to be used, the ejection frequency, and the like; and the shape, structure and number of the coupling members 64 is determined in such a manner that this flow path resistance, and this prescribed strength of the common liquid chamber 55 (print head 50) can be maintained.

The coupling members 64 (coupling plates 64' and 64") which join the wiring members 60 as described above may be integrally formed throughout the whole region where the nozzles 51 (piezoelectric elements 58) are formed in the full line print head (long print head) shown in FIG. 3A, but due to processing accuracy during manufacture, there will be large variation in the positions of the wiring members 60 (in other words, the positional accuracy of the wiring members 60 will be poor).

Figure 23:
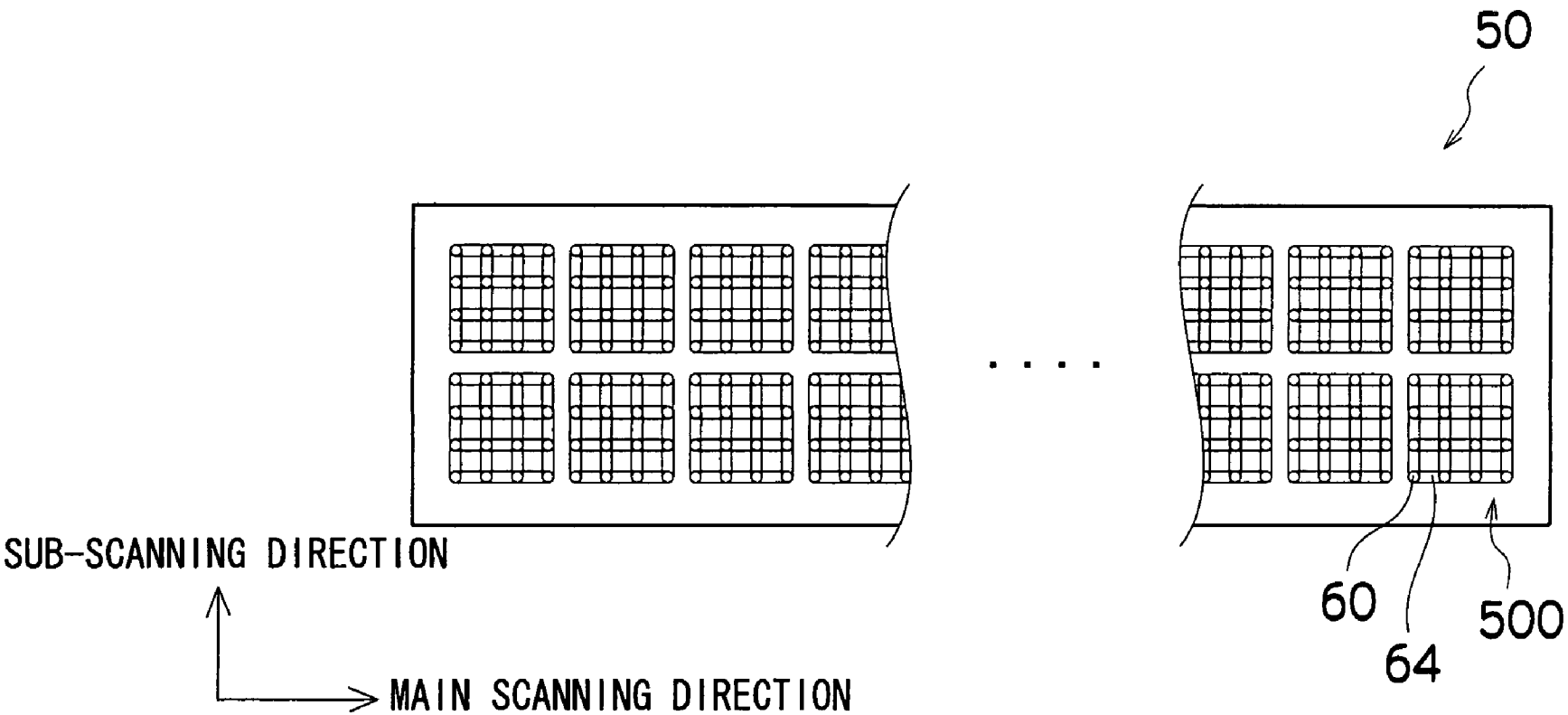
FIG. 23 is a plan perspective diagram showing one mode of the print head shown in FIGS. 3A and 3B.

Therefore, as shown in FIG. 23, variation in the positions of the wiring members 60 can be reduced by dividing the print head 50 (the region where the piezoelectric elements 58 and the wiring members 60 are provided) into a plurality of blocks, forming integrally wiring member groups (wiring member units) 500 comprising the plurality of wiring members 60 and a plurality of the coupling members 64 to correspond to each block, and then positioning the wiring member groups 500 in each block of the print head 50. Furthermore, deformation due to contraction and thermal expansion during heating can be alleviated in the respective wiring member groups 500.

FIG. 23 shows a mode where the print head 50 is divided into n segments in the main scanning direction (where n is an integer equal to 2 or more) and 2 segments in the sub-scanning direction, and hence 2×n wiring member groups 500 are provided. In the mode shown in FIG. 23, the respective wiring member groups 500 are not coupled together, but it is also possible to provide coupling sections 502 shown in FIG. 24 at the ends of the wiring member groups 500, in such a manner that the wiring member groups 500 can be coupled to each other.

Figure 24:
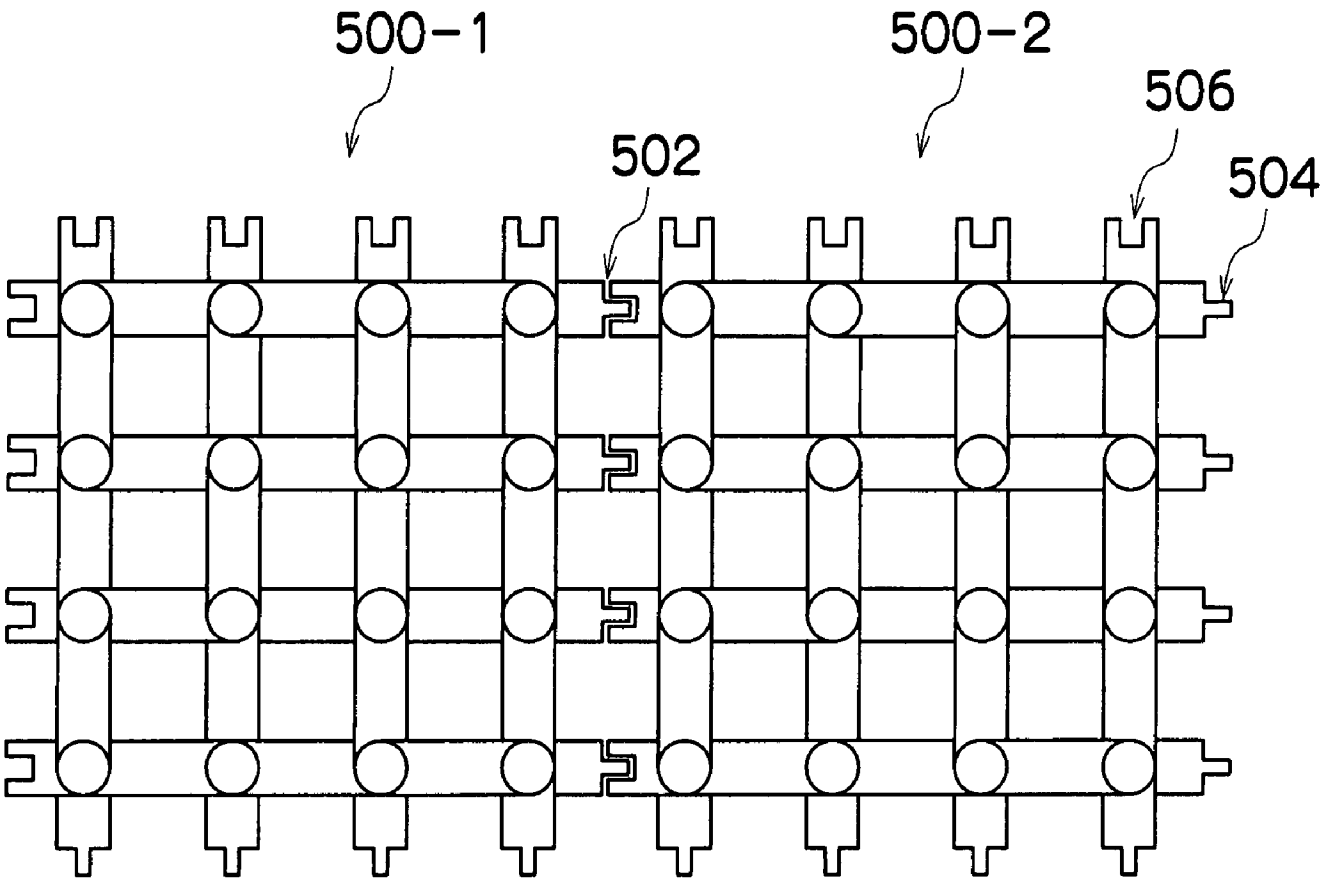
FIG. 24 is an enlarged view showing the detailed structure of the print head shown in FIG. 23.

FIG. 24 shows a mode where the wiring member groups 500-1 and 500-2 are coupled by means of coupling sections 502. The ends of the respective wiring member groups 500 (the sections corresponding to the coupling sections where the wiring member groups 500 are to be coupled together) are formed into either a projecting shape 504 or a recess shape 506.

In the mode shown in FIG. 24, projecting shapes 504 interconnect with recess shapes 506, but the shapes of the end sections of the wiring member groups 500 are not limited to projecting shapes and/or recess shapes, and other shapes may be employed as the end sections of the wiring member groups 500, provided that they allow mutually adjacent wiring member groups 500 to be coupled together with a prescribed coupling strength.

In coupling between the wiring member groups 500, it is desirable that the coupling sections 502 be provided with a prescribed amount of play, in such a manner that they can absorb any manufacturing variations in the wiring member groups 500 and any deformation of the wiring member groups 500 due to expansion or contraction.

By using wiring member groups 500 described above, it is possible to use the same type of wiring member group 500 even when two or more types of print heads 50 (the common liquid chambers 55) having different sizes are manufactured.

More specifically, the wiring member group 500 may be formed in such a manner that it has the size corresponding to the lowest common factor of the sizes of the print heads 50 or of the sizes of the common liquid chambers 55, and the number of wiring member groups 500 to be used is decided according to the size of the print head 50 or the common liquid chamber 55.

Figure 25:
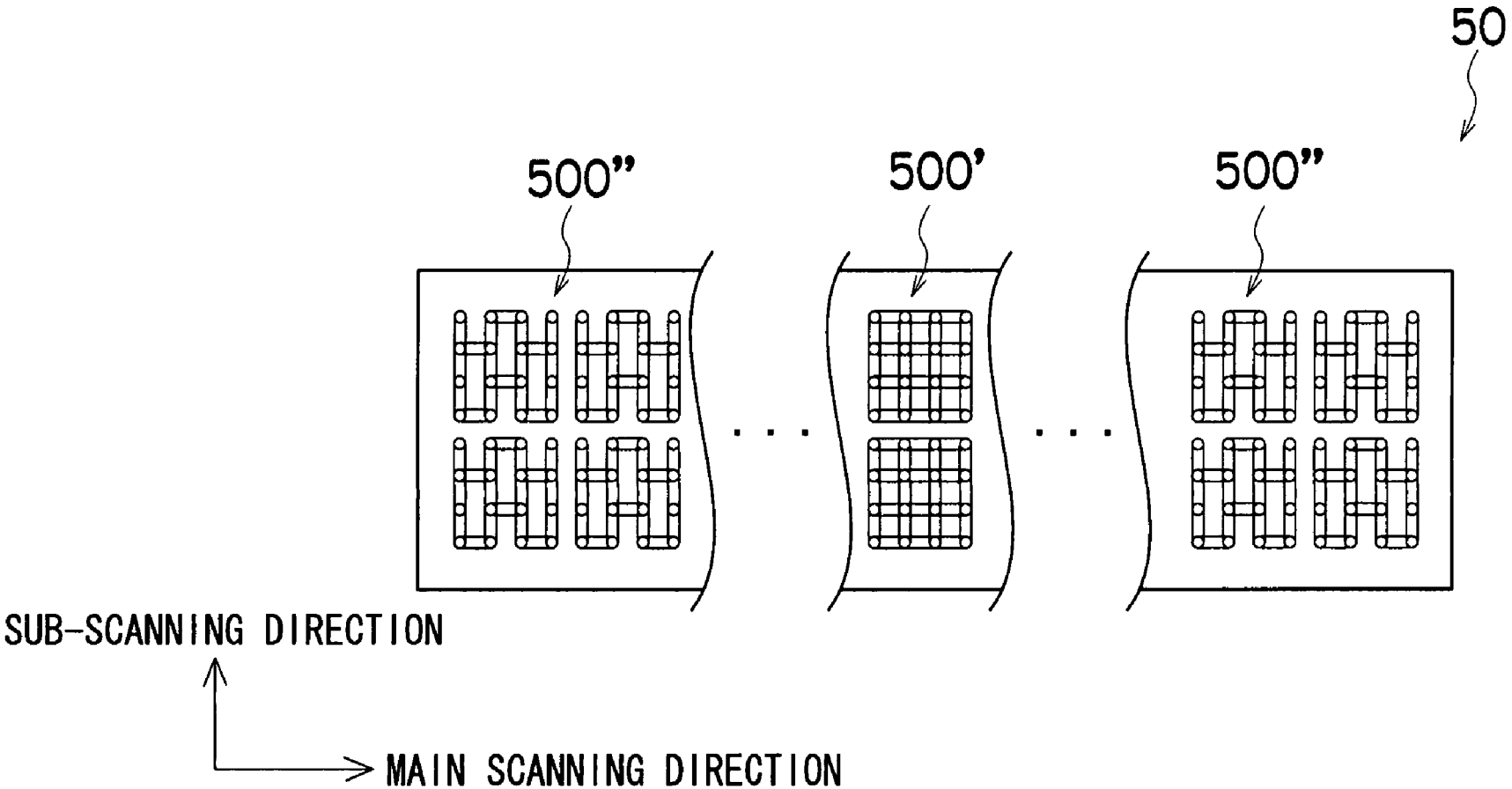
FIG. 25 is a diagram showing a further mode of the print head shown in FIG. 23.
Figure 26:
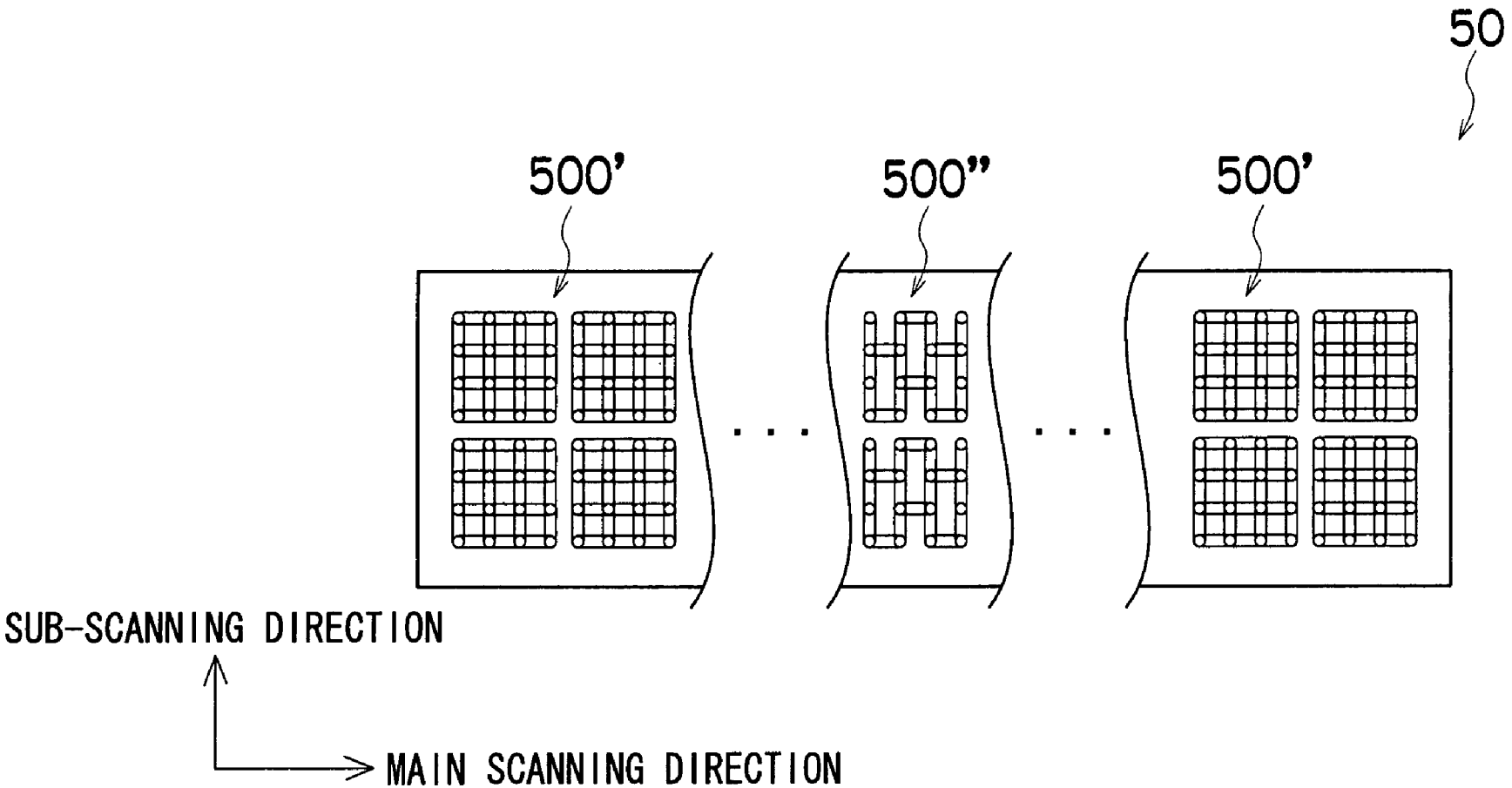
FIG. 26 is a diagram showing yet a further mode of the print head shown in FIG. 23.

In the mode shown in FIG. 24, wiring member groups 500 (of one type) having the same structure (composition) are formed inside the common liquid chamber 55, but as shown in FIG. 25 and FIG. 26, it is also possible to form two or more types of wiring member groups 500 having different structures.

FIG. 25 and FIG. 26 show a mode which combines wiring member groups 500' having dense coupling of the wiring members 60 (a case where the wiring members 60 having the coupling structure shown in FIG. 13 are used, for example), and wiring member groups 500" having sparse coupling of the wiring members 60 (a case where the wiring members 60 having the coupling structure shown in FIG. 14A are used, for example).

In the mode shown in FIG. 25, a wiring member group 500' having dense coupling of the wiring members 60 is used in the central region of the print head 50, whereas wiring member groups 500" having sparse coupling of the wiring members 60 are used in the regions of the print head 50 apart from this central region.

In the central region of the print head 50 where the wiring member group 500' is used, the strength of the print head 50 (the common liquid chamber 55) is ensured. On the other hand, in the regions of the print head 50 apart from the central region, where the wiring member groups 500" are used, the fluid resistance inside the common liquid chamber 55 is lower than in the central region of the print head 50, and hence the ink flows more readily in these other regions than it does in the central region of the print head 50.

It is also possible to adopt a plurality of types of wiring member groups 500, in such a manner that the number of coupling members 64 reduces sequentially from the central region of the print head 50 toward the respective ends thereof.

FIG. 26 shows a mode where the wiring member group 500" is used in the central region of the print head 50, and wiring member groups 500' are used in the other regions.

In other words, the wiring member groups 500' and 500" can be selected appropriately, according to the shape and structure of the print head 50, and the way of streaming the ink in the head.

In the print head 50 having the composition described above, the plurality of wiring members 60 (electrical columns) provided to correspond respectively to piezoelectric elements 58 and formed so as to pass through the interior of the common liquid chamber 55 are coupled together by means of the coupling members 64. Therefore, the rigidity of the print head 50 can be increased and the positioning of the wiring members 60 can be readily.

Furthermore, by forming the wiring members 60 and the coupling members 64 in a unified fashion by using a material having the same composition, the wiring members 60 and the coupling members 64 have an integrated structure and hence the strength is increased.

In the above-described embodiments, an inkjet recording apparatus which forms images on recording paper 16 by ejecting ink from nozzles 51 has been described, but the scope of application of the present invention is not limited to this and it may also be applied to a liquid ejection apparatus which ejects a liquid such as water, liquid chemical, treatment liquid, or the like, from ejection holes.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

ejection elements which include a plurality of ejection holes through which liquid is ejected, a plurality of pressure chambers in communication with the plurality of ejection holes, and a plurality of piezoelectric elements each of which deforms each of the pressure chambers and is provided on a side of the plurality of pressure chambers opposite from a side on which the ejection holes are formed;

a common liquid chamber through which the liquid is supplied to the plurality of pressure chambers, the common liquid chamber being provided on a side of the pressure chambers opposite from the side on which the ejection holes are formed;

a plurality of wiring members each of which is formed in such a manner that at least a portion of the wiring member rises upward from each of the piezoelectric elements or a vicinity of each of the piezoelectric elements, the at least the portion of the wiring member having a column-shape and passing through the common liquid chamber in a direction substantially perpendicular to a surface on which the piezoelectric elements are disposed, each of the wiring members including a conducting member which transmits at least one signal of a signal to be supplied to one of the ejection elements and a signal obtained from one of the ejection elements, and a covering member which is formed so as to cover the conducting member in the at least the portion of the wiring member having the column-shape and passing through the common liquid chamber; and a coupling member which structurally joins at least two of the wiring members adjacent to each other, the coupling member structurally coupling with the at least the portion having the column-shape of each of the at least two of the wiring members.

2. The liquid ejection head as defined in claim 1, wherein:

the plurality of ejection holes are arranged two-dimensionally in a row direction and a column direction; and the plurality of wiring members are arranged two-dimensionally in the row direction and the column direction on the surface on which the piezoelectric elements are disposed.

3. The liquid ejection head as defined in claim 2, wherein the coupling member is formed in at least one direction of the row direction and the column direction.

4. The liquid ejection head as defined in claim 2, wherein the coupling member is formed in a direction which is different from the row direction and the column direction.

5. The liquid ejection head as defined in claim 2, wherein the coupling members are formed in the row direction, the column direction, and a direction that is different from the row direction and the column direction, and the coupling members have a coupling structure in which at least three of the wiring members adjacent to each other are coupled by means of the coupling members.

6. The liquid ejection head as defined in claim 2, wherein the coupling member includes a plate-shaped member which joins at least three of the wiring members adjacent to each other, the plate-shaped member having a prescribed shape when projected onto the surface on which the wiring members are disposed.

7. The liquid ejection head as defined in claim 1, wherein the coupling member is made from a material including a material of the covering member.

8. The liquid ejection head as defined in claim 7, wherein the coupling member and the covering member are integrally formed from a material including resin.

9. The liquid ejection head as defined in claim 1, wherein the coupling member joins the plurality of wiring members having a plurality of coupling positions of different heights for the coupling member.

10. The liquid ejection head as defined in claim 1, wherein the coupling member joins the plurality of wiring members having at least two coupling positions of different heights for the coupling member.

11. The liquid ejection head as defined in claim 1, wherein the plurality of wiring members include wiring members having a non-coupled structure where the coupling member is not provided between the wiring members adjacent to each other.

12. The liquid ejection head as defined in claim 1, wherein liquid-contacting sections of the coupling member and the covering member which make contact with the liquid accommodated in the common liquid chamber have affinity for the liquid.

13. The liquid ejection head as defined in claim 1, wherein the coupling member is provided with a cavity section.

14. The liquid ejection head as defined in claim 1, wherein the coupling member has a filter structure comprising a plurality of through holes.

15. The liquid ejection head as defined in claim 1, wherein the coupling member has a shape in which angular portions of the coupling member are chamfered.

16. The liquid ejection head as defined in claim 1, further comprising:

a plurality of wiring member blocks including the coupling members, and the wiring members coupled together by the coupling members, wherein the wiring member blocks are arranged in a wiring member installation region where the wiring members are installed.

17. The liquid ejection head as defined in claim 16, wherein:

the wiring member blocks include the wiring member blocks having different coupling structures; and the wiring member blocks having the different coupling structures are combined in the wiring member installation region.

* * * * *